US010132086B2

(12) United States Patent
Wood et al.

(10) Patent No.: US 10,132,086 B2
(45) Date of Patent: Nov. 20, 2018

(54) BUILDING COVERINGS

(71) Applicant: Norcros Group (Holdings) Ltd, Staffordshire (GB)

(72) Inventors: Jonathan Wood, Staffordshire (GB); Stephen Dixon, Tarporley (GB)

(73) Assignee: Norcross Group (Holdings) Ltd., Staffordshire (GB)

( * ) Notice: Subject to any disclaimer, the term of this patent is extended or adjusted under 35 U.S.C. 154(b) by 0 days.

(21) Appl. No.: 15/516,249

(22) PCT Filed: Oct. 5, 2015

(86) PCT No.: PCT/GB2015/052907

§ 371 (c)(1),
(2) Date: Mar. 31, 2017

(87) PCT Pub. No.: WO2016/051211

PCT Pub. Date: Apr. 7, 2016

(65) Prior Publication Data

US 2017/0306632 A1 Oct. 26, 2017

(30) Foreign Application Priority Data

Oct. 3, 2014 (GB) ..... 1417562.4

(51) Int. Cl.
*E04F 13/08* (2006.01)
*E04F 13/14* (2006.01)

(52) U.S. Cl.
CPC ..... *E04F 13/0882* (2013.01); *E04F 13/08* (2013.01); *E04F 13/0862* (2013.01); *E04F 13/14* (2013.01); *H05K 999/99* (2013.01)

(58) Field of Classification Search
CPC ..... E04F 13/0882
See application file for complete search history.

(56) References Cited

U.S. PATENT DOCUMENTS 3,991,534 A * 11/1976 Brumlik ..... E04B 1/49 24/442
4,744,189 A * 5/1988 Wilson ..... B44C 1/28 40/908

(Continued)

FOREIGN PATENT DOCUMENTS

DE 4012613 A1 10/1991
EP 1542561 B1 * 2/2007 ..... A44B 18/0049
GB 2188080 A 9/1987

OTHER PUBLICATIONS

International Search Report issued in PCT/GB2015/052907 dated Jan. 22, 2016.

(Continued)

*Primary Examiner* — Rodney Mintz
(74) *Attorney, Agent, or Firm* — Mark H. Whittenberger; Holland & Knight LLP

(57) ABSTRACT

A wall surface covering system comprising: a wall surface covering for covering an underlying vertical support surface constituted by a wall, said wall surface covering comprising a rigid body; a first component of a hook-and-loop fastener fixable to the rigid body of the wall surface covering; and a second component of the hook-and-loop fastener that is fixable to the underlying vertical surface. The first and second components are cooperable such that, when the first component is fixed to the surface covering and the second component is fixed to the underlying vertical surface, the first and second components can be engaged to cause the wall surface covering to grip the wall. The first and second components are configured to cooperate to provide a fastening having a pull strength and a shear strength that are high enough to hold the surface covering in position on the vertical support surface, and a peel strength that is low enough to allow removal of the surface covering from the (Continued)

underlying surface by peeling the rigid body away from the wall.

12 Claims, 18 Drawing Sheets

(56) References Cited

U.S. PATENT DOCUMENTS 4,863,127 A * 9/1989 Handler ..... A47B 57/06 248/205.2
5,060,443 A * 10/1991 Pacione ..... E04F 13/0882 428/100
5,144,786 A * 9/1992 Pacione ..... E04F 13/0882 52/511
5,259,163 A * 11/1993 Pacione ..... E04F 15/02138 52/269
5,412,918 A * 5/1995 Wendel ..... E04B 1/6108 403/13
5,482,755 A * 1/1996 Manning ..... A44B 18/00 428/100
5,685,050 A * 11/1997 Murasaki ..... A44B 18/0061 24/442
6,367,218 B2 * 4/2002 Lombardo ..... B44C 1/28 52/311.2
2001/0002526 A1 6/2001 Lombardo
2005/0166372 A1 * 8/2005 Shepard ..... A44B 18/0049 24/442
2005/0181352 A1 * 8/2005 Shephard ..... A01K 5/0114 434/428
2012/0011795 A1 * 1/2012 Pacione ..... A47G 27/0293 52/506.05
2013/0097834 A1 * 4/2013 Pacione ..... E04C 2/00 29/402.08
2018/0171630 A1 * 6/2018 Pacione ..... E04F 15/02194

OTHER PUBLICATIONS

International Preliminary Report on Patentability in PCT/GB2015/052907 dated Apr. 4, 2017.

* cited by examiner

BUILDING COVERINGS

CROSS-REFERENCE TO RELATED APPLICATIONS

The subject application is a U.S. National Stage application of International Application No. PCT/GB2015/052907, filed on Oct. 5, 2015, which claims the priority of Great Britain Patent Application No. 1417562.4, filed Oct. 3, 2014. The contents of both applications are herein incorporated by reference in their entirety.

INTRODUCTION

This invention relates to building coverings including tiles, boards and panels for underlying vertical support surfaces such as walls, and more particularly but not exclusively to the fixing of such coverings to underlying support surfaces.

Referring to tiles and in particular wall tiles of ceramic material, traditional fixing of ceramic tiles using cement based adhesives create what is in effect a permanent bond between the tile and the wall making it difficult to remove tiles and often leading to damage of the underlying surfaces which are then in need of repair.

Accordingly, customers wishing to decorate/redecorate ceramic tiled walls, usually of bathrooms or kitchens, face the daunting task of tiling. As a result, research shows that currently customers change their bathrooms on average every 10 years. The main reason given for infrequent decorating of tiled areas is the overall fear of tiling projects.

This fear arises from a combination of problems:

a) the mess caused by tiling;
b) the perceived permanence of tiling and therefore the fear of choosing the wrong product;
c) the need to engage with a tradesman as tiling is seen as a skilled job;
d) the lack of knowledge when choosing a suitable tile adhesive; and
e) the fear of mixing and applying cement based tile adhesives.

With a view to addressing, overcoming, or at least substantially reducing the above problems, the Applicant has identified the requirement to encourage customers to tile more often by simplifying the entire tiling process, by providing a solution that:

a) removes the mess and hassle of using cement based tile adhesives;
b) makes it easy for customers to install tiles; and
c) allows customers to remove and replace tiles without creating any mess or damaging the surface of the underlying wall to which the tiles are fixed.

With this solution in mind the Applicant considered several years ago developing a fixing system that creates a non-permanent bond between ceramic tiles and the underlying wall surface, which maintains the ceramic tiles in their originally fixed position on the wall surface and yet allows the ceramic tiles to be removed, without experiencing the above mentioned problems.

The ceramic tiles would be of the kind that are currently used to apply to walls without any structural adaptions that would require prohibitively expensive changes in current, well-established manufacturing techniques. Such ceramic tiles and have been designated herein for convenience as 'conventional ceramic tiles'. Conventional tiles comprise a rigid body, and each tile typically has a weight of between 100 g and 4 kg, depending on the area, thickness and material of the tile.

The Applicant's first thoughts with regard to creating such a non-permanent bond involved the use of hook-and-loop technology of which the fasteners comprising cooperating hook-and-loop components for fixing items together for ease of fixing and detachment have been in existence for many years. These hook-and-loop fasteners are well-known in many fields, in particular in clothing where they are in common use, e.g. as a replacement of shoe laces and buttons. There are several well-known brands of hook-and-loop fasteners of which Velcro® is an immediately recognisable example.

Starting with existing hook-and-loop fasteners, the Applicant's first challenge was to verify if hook-and-loop fasteners were strong enough securely to fix a large format conventional ceramic wall tile to an underlying wall surface. Such large format ceramic tiles are produced in several different sizes, for example 360 mm by 275 mm, 300 mm by 300 mm, 400 mm by 300 mm, 400 mm by 150 mm, 450 mm by 450 mm, 600 mm by 150 mm, 600 mm by 300 mm, 600 mm by 600 mm, 850 mm by 280 mm, 900 mm by 450 mm, 900 mm by 600 mm and 1000 mm by 160 mm.

Existing hook-and-loop fastener were tested by gluing one fastener component to an underlying wall surface and the other component to the backs of the conventional ceramic tiles, and fixing the conventional large format tiles to the wall surface by pressing them into position to engage cooperating hook and loop components of the hook and loop fastening. The hook-and-loop fastened tiles were then removed from the underlying wall surface.

Initial results were encouraging and it was clear from the outset that some hook-and-loop fasteners were capable of securing conventional ceramic wall tiles to the underlying wall surface. However, although these initial tests results were encouraging, they identified a critical problem, namely, existing hook-and-loop fasteners fell into two categories and neither category provided a solution, namely:

1. fasteners that were capable of securely fixing a ceramic tile but created a bond that was too strong and so prevented easy removal of the hook-and-loop fastened tiles, such as Velcro® fasteners;

2. fasteners that allowed easy tile removal of the hook-and-loop fastened tiles but that created a bond that was not strong enough to hold the tile securely to the wall, such as Fastna fasteners; and 3. fasteners that permit unacceptable lateral movement of the tiles within the plane of the wall, such that the position of the tiles 'creeps' over time.

For the initial tests the applicant used off-the-shelf hook and loop products commonly found at major DIY stores. Tests showed that products such as Velcro® adhesive backed heavy duty fasteners created a bond that was too strong for easy tile removal and products such as Fastna low-profile self-adhesive fasteners created a bond that was not strong enough to support the weight of a tile, particularly a large format tile. In other words, the pull strength and shear strength of the off-the-shelf fastenings was either not sufficient to hold the tile securely on the wall or was too strong to allow easy removal of the tile. In both cases, the fasteners permitted too much lateral movement within the plane of the tile once the tile had been fastened to the wall.

These initial test results showed that the existing hook-and-loop fasteners had different cooperating hook and loop engagement properties when used to fix conventional ceramic tiles to walls. Thus, hook-and-loop fasteners having a bond which was 'too strong and prevented easy tile removal' had different hook and loop engagement properties from those hook-and-loop fasteners having a bond that was 'not strong enough to hold the tiles securely in place'.

The Applicant found that the issues identified above were particularly problematic because of the following reasons. Firstly, the relatively heavy weight of a rigid tile body means that the tile's own weight tends to pull the tile off the wall. Secondly, this first factor is exacerbated by the fact that the tile must be hung vertically on the wall, rather than horizontally on the floor, which means the weight of the tile tends to apply a shear stress to the fastening. Thirdly, the rigidity of the tiles makes a peeling motion difficult. This is in contrast to systems that comprise a covering formed of a flexible material: in such systems peeling is relatively easy and the fastening must be strong enough to avoid inadvertent peeling of the covering as it flexes.

Searches carried out by the Applicant revealed that hook-and-loop fasteners had already been proposed to fix decorative ceramic tiles to floors in UK Patent Application GB 2188080A to Alan Watkins et al (Watkins) entitled 'Fixing Tiles' filed 22 Mar. 1986 and published 23 Sep. 1987. Indeed, Watkins is concerned with the problem of replacing old adhesively affixed decorative ceramic tiles of ceramic materials to walls and ceilings, without difficulty and damage to the wall surface so it was much easier to the change the colour or the character of the tiles, especially by the householder.

Watkins' solution to the problem is to secure the hook-and-loop components of a hook and loop fastening system to a tile and underlying surface respectively which allows one or more tiles to be removed and replaced at will by an unskilled operator. One fastener component, preferably the loop component, is secured to, and may cover, the whole of the rear surface of the tile, or to reduce costs be supplied in elongated strips or small squares applied near the tile corners and the other fastener component, preferably the hook component, is secured to the underlying surface.

Using the reference numbers employed in Watkins, the tile 5 is of ceramic or of a synthetic plastics material with the rear surface of the tile 5 having structural adaptions constituted by a continuous peripheral recess 6 within which the hook-and-loop fastener may be located and by strengthening ribs 7, 8 running diagonally in the thickness of the tile 5.

The loop component 9 is a nylon fabric having a large number of random loops 10 in its surface and the hook component 13 has large number of nylon hooks 14 distributed evenly over its surface. The loop and hook components 9 and 13 have respective self-adhesive coatings 11 and 15 covered by respective cover strips 12 and 16.

To install the tile 5, four short lengths of the fastening, supplied with the two components engaged together, are located in the channel 6 adjacent the corners of the tile and with the cover 12 having been removed are secured in the channel 6 by the contact adhesive 11 after which the cover 16 is removed and the tile 5 pressed into position on a wall or ceiling surface 17. Tile replacement or position adjustment can be achieved by readily pulling away the tile 5 from the surface 17 thereby disengaging the fastener components 9 and 13, leaving the hook component 13 in position on the surface 17 ready to engage the loop components 9 of another tile 5. The contact adhesive used is sold as pressure sensitive adhesive 7909 by Selectus Ltd, although other adhesives may be used.

However, Watkins is completely silent on the engagement properties of the cooperating hook and loop components 9 and 13 of the hook-and-loop fastener which are merely shown diagrammatically in FIGS. 2 and 3. All that is said in Watkins is that the loop component 9 is a nylon fabric having a large number of random loops 10 in its surface with a self-adhesive coating, the hook component 13 has a large number of nylon hooks 14 distributed uniformly over its surface and has a self-adhesive coating 15 with a cover strip 16.

Thus, there is no indication, suggestion, teaching, or disclosure in Watkins as to how to solve the critical problem highlighted and sought to be solved by the Applicant. Basically, Watkins discloses a solution which is unworkable.

Moreover, the structural adaptions constituted by the continuous hook-and-loop fastener location recess 6 and strengthening ribs 7, 8 would require prohibitively expensive changes in current, well-established manufacturing techniques, as mentioned previously.

Accordingly, it is no wonder that the Watkins hook- and loop-fastened ceramic tiles of Watkins, have, to the Applicant's knowledge, never seen the light of day, at least in the UK market place.

The Applicant's searches also revealed the use of hook-and-loop fasteners in relation to other types of coverings, in the following patent specifications namely:

1) U.S. Pat. No. 5,042,221 to Tac-Fast Systems, filed 28 Mar. 1989, entitled 'Apparatus for applying a wall covering and wall covering' and published 27 Aug. 1991 (Tac-Fast 221) and disclosing the fixing of flexible decorative wall coverings to wall boards;

2) WO 00/74544 A1 claiming priority from U.S. CIP Ser. No. 09/326,634 (CIP) filed 7 Jun. 1999 to Tac-Fast Systems published 14 Dec. 2000 (Tac-Fast 441) and corresponding EP 1,162,952 and EP 1,182,952) disclosing the fixing of anchor sheets for covering an underlying substrate such as a floor, to a decorative covering such as a carpet; and 3) U.S. Pat. No. 5,060,443 filed 19 Jul. 1989 as a continuation in part of US Ser. No. 148,711 filed 22 Jul. 1988 to Tac-Fast Systems entitled 'Anchor Board System' published 29 Oct. 1991 (Tac-Fast 443); and disclosing the fixing of wall boards, sheets or panels to underlying wall/floor supporting surfaces.

Using the reference number employed in U.S. Pat. No. 5,042,221 to Tac-Fast Systems, in Tac-Fast 221, a wall board bears one half, preferably the hook half provided on a hook surface 15, of the hook and loop fastening system, and a wall covering 2 bears the complementary half, preferably the loop half 9, of the fastening system on one side and a decorative finish on the other side. The wall covering 2 consists of a flexible fabric, paper or plastic backing layer 8 with integral loops 9 provided in, and covering substantially all of, the backing layer 8. The invention of U.S. Pat. No. 5,042,221 is concerned with the difficulties that may be encountered in applying a flexible wall covering to a wall surface by the tendency for the covering to bunch and wrinkle which because the appearance of the wall covering is important, a wrinkled wallpaper would not normally be acceptable.

For ease of applying the wall covering 2 to the wall and overcoming these difficulties, the flexible wall covering 2 is in roll form, mounted on a spindle 7 carried by a rotatable support 1, unrolled under tension provided by a brake 4 and fed it to an applicator bar 3, and the position of roll support is adjustable by legs 6 and height adjusters 17, as shown in FIG. 1. Alternatively, the wall covering may be applied to a ceiling as will be apparent from FIG. 3.

However, like Watkins, Tac-Fast 221 is completely silent on the cooperating hook and loop engagement properties of the hook-and-loop fasteners of which loops in a backing 9 of a layer 8 are merely shown diagrammatically in FIG. 2 and in FIG. 4 on the back surfaces 12 of a cover moulding 10 and a base board 11. Tac-Fast 221 says only that the wall covering consists of a flexible layer 8 having a decorative finish on a fabric web backing 9, the loops being integral with the backing 9 and covering all of the back surface of the wall covering and that the structure of the wall covering with the loops part of the fabric backing provides strength to the wall covering so that it may be stripped from the wall if desired. Nothing is said about, or shown of, the complementary hooks other that in connection with the application of the wall covering which should be in a position to engage its loop surface with the hook surface 15 of the building wall or ceiling (FIG. 1).

Tac-Fast 441 discloses improvements in attaching a flexible anchor sheet for use under carpets or other decorative coverings which when installed acts to tie the decorative covering as a functional unit to add mass and stability to such unit. The anchor sheet is covered over one side with hooks for anchoring the decorative covering to it by the engagement of complementary loops on the underside of the decorative covering. Tac-fast 441 is concerned in particular with floor coverings rather than wall coverings. Furthermore, the floor covering of Tac-fast 441 is a relatively light, flexible sheet rather than a relatively heavy, rigid covering, which would therefore not be subject to the specific issues arising from the weight and rigidity of wall coverings such as tiles.

The anchor sheet may itself be attached to the underlying substrate, such as a floor or wall floor, or it may be loose laid on a floor to form a sub-floor where the anchor sheet can have sufficient mass so as to prevent movement of the anchor sheet. The improvements involve the provision of attachment devices, separate from the hook and loop fastening between the anchor sheet and decorative covering to minimize the attachment of the anchor sheet to the underlying substrate, and to allow for the possibility of spacing between the anchor sheet units in order to accommodate atmospheric changes.

The attachment devices for anchor sheets of modular form when abutting or overlapped can be held to the underlying floor to form totally or partially free floating units which can provide for expansion and contraction of the anchor sheets to accommodate such changes such as temperature and humidity. And the anchor sheets form a contiguous mass without a large number of attachment locations to the underlying substrate and without having to drill through the anchor sheets themselves. The attachment devices/pieces each fits into an area of reduced thickness in a first area of the anchor sheet and a cut-away portion of a smaller second area is within the first area of the anchor sheet and are preferably corner pieces which overlap the areas of reduced thickness on a number of anchor sheets.

Again, as with Watkins and Tac-Fast 221, Tac-Fast 441, is completely silent on the cooperating hook and loop engagement properties of the hook-and-loop fasteners and merely shows in FIG. 1 an anchor sheet 1 covered on one surface 3 with diagrammatically illustrated hooks for anchoring a decorative covering such as a carpet, to it by the engagement of complementary loops (not shown) on the underside of the decorative covering.

Tac-Fast 443 discloses an anchor-board construction system suitable for incorporation into the interior of buildings and homes for use as a cladding to replace conventional plaster based wall board. The anchor board has one surface thereof incorporating a layer of protruding attachment hooks which can accept and retain decorative and functional surface finish units, such as carpet tiles, wallpaper, or fabric with looped backing or wood panelling, embodying a looped or other suitably piled posterior surface portion for attachment to the hooks simply by pressing in place. Interior surface walls are usually formed by nailing or screwing drywall panels to frame members after which finishing is necessary involving covering of nail and screw heads, and joins between panels to provide a smooth continuous surface which does not show the joins or nail or screw heads and is free of both dents and bumps.

Drywall panels often have slightly recessed joining margins so that tape must be applied without forming a ridge in the surface and frequently the panels must be cut to fit and these recessed margins may not be conveniently used. Thus a large amount of skilled labour is needed involving the application of tape and plaster over adjoining board joints, the plaster being applied in several layers with sanding down resulting in the generation of unhealthy dust. Then, it is necessary to decorate the bare, plaster boards. If mistakes are made, their rectification increases completion time and further increases costs. Tiling requires the application of adhesive and later grouting. These problems are addressed by providing a wall or other surface covering which presents a surface in less need of skilled finishing operators than is conventional by providing an interior surface cladding of substantially rigid sheet material adapted to be cut to the shape of an area to be clad and being attachable to a backing support: the sheet material has one half of a hook and loop attachment system projecting from a front surface of the sheet material and distributed substantially over the whole of the front surface whereby finishing material having the other half of the hook and loop attachment system on the rear surface may be attached anywhere on the front surface.

The cladding is conveniently in the form of panels which can be cut into smaller pieces and may be trimmed to the shape of the area to be covered. Wall panels may be of conventional plasterboard. The hooked attachment may be distributed over substantially one full surface of the board. And the cladding system may provide for semi-permanent application to a support by a hook and loop fastening. The cladding has a reverse surface incorporating, over at least a portion of the area, a plurality of fastening elements selected from the hooks and loops for removably securing the component to the support. The cladding may be secured to a solid wall. Plaster and fibreglass materials have the additional advantage that the hooks or loops can be manufactured into the cladding during construction of the board. With plasterboard cladding, the hooks may be secured to, and protrude from, a substantially continuous film or mesh and the continuous film, mesh or other additional strata may be readily incorporated into the panels during manufacture.

Handling of the panels in pairs having strata faces in adjoining face to face relationship is contemplated with possible weight restrictions to avoid hook damage. Attachment of the panels to floors, walls and ceilings is contemplated generally by nailing, stapling or gluing and the like. However, extension of the system using respective hook and loop fastenings, for attachment of the panels to underlying supports is considered part of the system with their respective loop or hook attachments. Incorporation of film or mesh into plasterboard will lead to reinforcement which facilitates the use of stapling machines to wire staples to the boards, to studding or other supports and which have less tendency to pull through due to the reinforcement. When nails or screws are used, there will be a tendency for the resilient hook and loop fastening between the cladding and a finish sheet to absorb or disguise any dent at the nail or screw head.

Referring to FIGS. 1 and 2, a cladding panel 20 may have the typical dimensions of a conventional plaster board panel, i.e. four feet width by 8 feet length, a base thickness of one half and inch, with additional thickness being provided by the hooks 24 of hook and loop fastening means. The hooks 24 may be provided on a film 23 secured to panel 20 and anchored thereto by anchor lugs 26 held in the plaster body portion 28 of the panel 20 and bounded by a rear paper layer 30 or by a mesh embedded in the plaster body portion 28 such that the hooks extend out of the surface of the panel 20. As shown in FIG. 3, the cladding panels 20 having hooks 24 may be nailed to a wall frame 32. Wainscot panelling 34 is attached thereto by way of the hooks 24. Above the wainscoting, a finish sheet 50 (FIG. 4) of wallpaper, plastic, panelling, textile, ceiling tiles, carpet, carpet tiles etc. has a decorative finish 52 which is glued by a layer 54 to an adhering layer of woven or felt loops 39. The finish sheet 50 is attached to the cladding panels 20 by engaging the loops 39 with the hooks 24. The cladding may be mass produced with associated cost savings and various attachments and may provide a system adapted for extremely rapid erection, tear down and/or replacement. And the various attachment parts may be substantially undamaged by installation and removal from the nailed or screwed anchor sheets/panels bearing one half of the hook and loop fastening system.

Unlike Watkins, Tac-Fast 221 and Tac-Fast 441, the respective structures of the cooperating hook and loop components of the hook-and-loop fastener used is disclosed and shown in Tac-Fast 443. Thus, in FIGS. 1 and 2 of Tac-Fast 441, a cladding panel 20 has one surface covered by the hooks 24 of a hook-and-loop fastener of which the hooks 24 provide the panel 20 with additional base thickness. The hooks 24 are provided on a film 23 secured to, and extending out of, the panel surface and anchored thereto by anchor lugs 26 held in the plaster body portion 28. Opposite the hooks 24, the panel surface is bounded by a rear paper layer 30. Alternatively, the film 23 may be replaced by a mesh embedded in the plaster body portion 28 such that the hooks extend out of the surface of the panel 20.

FIGS. 1, 8, 9 and 10 of Tac Fast 441 show the structure of the hooks 24 as being U-shaped with the base of the U protruding from the panel surface where one of the arms of the U is provided with a gap adjacent to its protruding base. The structure of the loops is shown in the enlarged section of FIG. 4 in which a portion of a finish sheet 50 with a decorative finish 52 is glued by a layer 54 by the adhering layer of woven or felt loops 39 which are of various sizes. The finish sheet 50 can be attached to the cladding panels 20 (FIG. 3) by engaging the loops 39 with the hooks 24. There is nothing to indicate that the structure of the hooks 24 and loops 39 is anything other than conventional.

And as, with Watkins, Tac-Fast 221 and Tac-Fast 441, the specification of Tac-Fast 443 is completely silent with regard to the engagement properties of the cooperating hook-and-loop fasteners of the cladding panels 20 and finish sheet 50 respectively.

Thus, there is no indication, suggestion, teaching, or disclosure in Watkins Tac-Fast 221, Tac-Fast 441 and Tac-Fast 443 as to how to solve the critical problem highlighted, and sought to be solved, by the Applicant.

With further consideration of this critical problem, the Applicant ascertained that three fundamental challenges needed to be addressed which concerned the engagement properties of the cooperating hook and loop components of the fasteners namely:

1. ensure that the hook-and-loop fastened conventional tile is held securely on the wall;

2. ensure that the securely held hook-and-loop fastened conventional tiles on the wall cannot move horizontally or vertically; and 3. ensure that the securely held hook-and-loop fastened tiles on the wall are easy to remove from the wall.

In order to provide a solution for each of the above challenges, Applicant discovered during its research, investigations, tests and experiments, that the physical forces relevant to the associated engagement properties of the cooperating hook and loop components needed to be addressed, namely:

1. Pull Strength to determine the bond required to ensure the tile remains securely fixed to the wall;

2. Shear Strength to determine the bond required to ensure the tile does not move once it has been fixed to the wall; and 3. Peel Strength to determine the bond required to allow easy tile removal with minimal force.

Further initial tests and experiments were carried out to establish if the pull, shear and peel strengths of stronger hook-and-loop products could be reduced by experimenting with combinations of partial strips of hook-and-loop material, on both the wall surface and the back of tiles. Test results showed that although using partial strips did resolve some of the issues, the hook and loop components needed full wall and back of tile coverage to ensure confidence in the hook-and-loop fastener used.

However, all these initial tests did was highlight the need to invent, develop, and design a hook and loop solution tailored to the Applicant's specific requirements with regard to pull strength, shear strength and peel strength.

The Applicant's object was to overcome the problem of creating a non-permanent bond between the hook-and-loop fastened tiles and the underlying wall surface so that ceramic wall tiles could be held securely on, yet be easily removed from, the underlying wall surface without damaging the wall surface.

So, the Applicant carried out research, investigations, tests and experiments using a variety of cooperating hook and loop components having different engagement properties which were applied to conventional ceramic wall tiles and an underlying wall surface and which spanned a period of over two years.

More specifically, the Applicant's tests and experiments involved cooperating hook-and-loop fasteners having multiple combinations and variations of engagement properties and different Pull Strengths, Shear Strengths and Peel strengths until the right mix of high Pull Strength, high Shear Strength and low Peel Strength was obtained with large format conventional ceramic wall tiles having inter alia the dimensions of 360 mm by 275 mm, 300 mm by 300 mm, 400 mm by 300 mm, 400 mm by 150 mm, 450 mm by 450 mm, 600 mm by 150 mm, 600 mm by 300 mm, 600 mm by 600 mm, 850 mm by 280 mm, 900 mm by 450 mm, 900 mm by 600 mm or 1000 mm by 160 mm.

Surprisingly, during these tests and experiments, the Applicant discovered a principle which is that of synergy between the physical forces of high Pull Strength, high Shear Strength and low Peel Strength. This synergy occurred, even though the engagement properties of certain combinations of hook and loop components provided relatively low engagement strength for each individual pair of cooperating hook and loop components and achieved the desired low Peel Strength, yet the arrangement and structure of the hook and loop components achieved the desired high Pull Strength.

STATEMENTS OF THE INVENTION

Against this background, in accordance with one aspect of the invention, there is provided a wall surface covering system comprising: a wall surface covering for covering an underlying vertical support surface constituted by a wall, said wall surface covering comprising a rigid body; a first component of a hook-and-loop fastener fixable to the rigid body of the wall surface covering; and a second component of the hook-and-loop fastener that is fixable to the underlying vertical surface. The first and second components are cooperable such that, when the first component is fixed to the surface covering and the second component is fixed to the underlying vertical surface, the first and second components can be engaged to cause the wall surface covering to grip the wall. The first and second components are configured to cooperate to provide a fastening having a pull strength and a shear strength that are high enough to hold the surface covering in position on the vertical support surface, and a peel strength that is low enough to allow removal of the surface covering from the underlying surface by peeling the rigid body away from the wall.

A sufficiently high pull strength and shear strength means that the covering will remain in place on the vertical surface over time, and in particular means that it will not fall from the vertical surface under its own weight, or under the sort of forces that will typically be applied during normal use, for example by a person leaning on the wall. A sufficiently low peel strength means that i) the rigid body of the covering can be peeled away from the wall using a force of a magnitude that can be applied by hand ii) the tile will peel away from the wall without breaking.

From another aspect, the invention resides in a wall surface covering for covering an underlying vertical support surface constituted by a wall, said wall surface covering comprising a rigid body and a first component of a hook-and-loop fastener fixable to the rigid body, the first component being fixable to a second component of the hook-and-loop fastener that is fixed to the underlying vertical surface, such that the first and second components engage so as to cause the wall surface covering to grip the wall, wherein the first component is configured to cooperate with the second component to provide a fastening having a pull strength and a shear strength that are high enough to hold the surface covering in position on the vertical support surface, and a peel strength that is low enough to allow removal of the surface covering from the underlying surface by peeling the rigid body away from the wall. The first component of the hook-and-loop fastener may be fixed to or integrated with the rigid body of the wall surface covering.

The invention also resides in a covering, such as tiles, boards or panels, for an underlying support surface constituted by a wall, said surface covering being fixable to the underlying surface by means of the cooperating components of a hook-and-loop fastener being pressed into engagement, one of said components being fixable to the surface covering and the other of said components being fixable to the underlying surface, characterised in that the hook and loop components have cooperating engagement properties such as to provide physical forces which hold the surface covering in position on, yet allow removal of the surface covering from, the underlying surface, and which physical forces are in synergy.

From another aspect, the invention resides in a wall covering, such as tiles, boards or panels, for an underlying support surface constituted by a wall, said surface covering being fixable to the underlying surface by means of the cooperating components of a hook-and-loop fastener being pressed into engagement, one of said components being fixable to the surface covering and the other of said components being fixable to the underlying surface, characterised in that the hook and loop components have cooperating engagement properties such that there is synergy between the physical forces of pull strength and Shear strength holding the surface covering in position on the wall surface and peel strength allowing removal of the surface covering from the wall surface.

In another way of carrying out the principle discovered by the Applicant, the invention in accordance with another aspect resides in a hook-and-loop fastener when used for holding a wall surface covering, such as tiles, boards or panels in position on an underlying surface constituted by a wall surface, yet allowing removal of the surface covering from the underlying surface by means of the hook and loop components of the fastener having cooperating engagement properties providing physical forces which are in synergy.

In a further way of carrying out the principle discovered by the Applicant, the invention in accordance with a further aspect resides in a hook-and-loop fastener when used for fixing a wall surface covering, such as tiles, boards or panels to an underlying surface constituted by a wall surface by means of the hook and loop components of the fastener having cooperating engagement properties such that there is synergy between the physical forces of pull strength and Shear strength holding the surface covering in position on the wall surface and peel strength allowing removal of the surface covering from the wall surface.

Thus, from another perspective, the synergy provided by the wall surface covering, according to the invention balances, or provides a balance, between relatively high pull strength, relatively high Shear strength and relatively low peel strength.

It can also be said that the synergy between all the physical forces of pull strength, shear strength and peel strength is optimised by the cooperating engagement properties of the hook and loop components. And in accordance with the invention, this synergy can be arranged to be at an optimum.

The invention also addresses a secondary and equally important challenge by providing a cost-effective solution to ensure that the product price point is acceptable in comparison with traditional adhesive fixing methods.

As previously mentioned, large format ceramic tiles are produced in several different sizes ranging inter alia from 360 mm by 275 mm, 300 mm by 300 mm, 400 mm by 300 mm, 450 mm by 150 mm, 600 mm by 300 mm, 850 mm by 280 mm and 900 mm by 450 mm. However, it should be appreciated that the invention also comprehends the use of smaller format ceramic tiles having inter alia the dimensions of 100 mm by 100 mm, 100 mm by 150 mm, 150 mm by 150 mm, 200 mm by 100 mm, 200 mm by 200 mm, 300 mm by 100 mm and 300 mm by 200 mm.

The following optional features may apply to any of the aspects described above:

The first component of the hook-and-loop fastener may be fixed to or integrated with the rigid body of the wall surface covering.

The peel strength of the fastening may be less than the stress required to fracture the rigid body of the wall surface covering.

The shear strength of the fastener may be greater than the shear force applied by the weight of the tile.

The first and second components may be configured to provide a synergy that balances, or provides a balance, between relatively high pull strength, relatively high shear strength and relatively low peel strength.

The synergy between all the physical properties of pull strength, shear strength and peel strength may be optimised by the cooperating engagement properties of the hook and loop components.

The first and second components may be configured to limit lateral movement of the surface covering in the plane of the underlying vertical surface to less than 2 mm. In particular, the first and second components may be configured to limit lateral movement of the surface covering in the plane of the underlying vertical surface to less than 1 mm.

The hook component preferably has a low and smooth profile. In particular, the hook component may have a thickness of between approximately 0.3 mm and approximately 0.75 mm.

The loop component may have a low and smooth profile. In particular, the loop component may have a thickness of between approximately 0.3 and 0.75 mm.

The hook and loop components may have a combined thickness which is no greater than approximately 1.5 mm.

The Pull Strength of the fastening may be in the range of 0.5 $N/cm^2$ to 2.50 $N/cm^2$. The shear strength of the fastening may be in the range of 20 $N/cm^2$ to 40 $N/cm^2$. The peel strength may be in the range of 0.2 $N/cm^2$ to 1.0 $N/cm^2$.

More preferably, the pull strength may be in the range of 1.0 $N/cm^2$ to 2.0 $N/cm^2$, the shear strength may be in the range of 25 $N/cm^2$ to 35 $N/cm^2$ and the peel strength may be in the range of 0.4 $N/cm^2$ to 0.8 $N/cm^2$.

In an embodiment that achieves a particularly advantageous balance of physical properties, the pull strength may be approximately 1.5 $N/cm^2$, the shear strength may be approximately 30 $N/cm^2$ and the peel strength may be approximately 0.6 $N/cm^2$.

At least one of the first and second components is a hook component and the other of the first and second components is a loop component.

The second component may be a hook component. The hooks of the hook component may comprise a stem and a cap, and the cap may extend beyond the stem in at least two mutually transverse directions to engage the loop fastening bi-directionally.

The hooks may be generally of mushroom shape.

The generally hooks may be microscopic. The hooks may be tightly packed. The hooks may be arranged in rows.

The hook component may be an extrusion moulding. The extrusion moulding is preferably of polypropylene. The hook component may be waterproof.

The first component may be a loop component.

The loops of the loop component may be made of a lightweight knitted material.

The loop weight may have a range of from about 80 to about 120 grams per square meter. This weight range is particularly advantageous as it provides a loop density that results in a pull stress and shear stress that is adequate to hold the wall covering in place on the wall, without the covering falling off under its own weight.

The loops of the loop component may be carried by a carrier layer of plastics material. The carrier layer may have a thickness of about 45 microns and is preferably made of polyethylene terephthalate.

A combination of microscopic, mushroom-shaped, tightly-packed rows of hooks and light-weight knitted loops provides widespread cooperating engagement over the entire surface of the hook component. This provides a particularly effective balance between pull, shear and peel strengths.

One or both of the first and second components may have a glued backing for fixing the respective components to the surface covering and/or the wall surface.

The or each glued backing is provided with a protective release liner.

The release liner is a plastics film having a thickness of about 36 microns and is preferably of polyethylene terephthalate.

The glued backing is provided with a backing glue comprising a pressure-sensitive high-tack glue.

The second component may be fixed to, or incorporated into, the wall surface.

The second component may be fixed to, or incorporated into, a building panel or board such as plaster board which forms the underlying wall surface.

The second component may be carried by a roll.

The wall surface covering may be a tile.

The wall surface covering system may include a tanking roll.

The tanking roll may comprise a waterproof layer and a removable backing layer. The removable backing layer may be spliced so as to permit removal of left and right sides of the backing layer separately.

Referring in more detail to the tests and experiments conducted by the Applicant, these were first initially carried out with conventional large format ceramic tiles.

The first breakthrough came when Applicant tested a hook and loop component combination, referred to herein as Combination A of which the two components were supplied in pre-glued rolls with an integrated release liner to facilitate installation trials. These installation trials of Combination A established that the most effective configuration consisted of hook component on the underlying wall surface and loop component on the back surface of the conventional large format ceramic tile.

Installation of these large format ceramic tiles consisted of three simple steps, namely: applying the pre-glued hook to the surface of a wall using a similar process to wallpapering; fixing the loop-backed tiles onto the wall by pressing them into position to engage the hook and loop fastening; and applying the grout between, and surrounding, the tiles using traditional tools.

Removal of the hook-and-loop fastened tiles also consisted of three simple steps, namely: removing the grout surrounding a single tile; using a trowel tool to prise the single tile off the wall; and using a trowel tool to remove all other tiles and grout.

In a first iteration of Combination A the hook and loop components were supplied with a foam backing to absorb minor bumps and cavities on the surface of the wall. However, because installation testing showed increased movement causing grout cracking due the thickness of the foam, the foam backing was subsequently removed and a new set of samples was prepared as Combination A1.

Although further installation testing showed that Combinations A and A1 worked well, both were manufactured using older Velour knitting technology resulting in a relatively high manufacturing cost and therefore an unrealistic selling price.

Therefore, Applicant's testing shifted to the use of a new, more efficient production line using plastics extrusion technology for the hook component and a switch in focus to finding cost effective alternatives to Combination A/A1. Test samples of an extrusion moulded hook component and a lightweight knitted loop component whose engagement properties closely matched those of Combination A/A1 were prepared for testing and designated herein as Combination B.

Initial testing of the Combination B hook-and-loop fastener proved very successful and highlighted additional benefits over Combination A/A1. Firstly the extruded hook component is waterproof and therefore is ideally suited to shower room installations acting as a tanking. Secondly, being designed with low and smooth profiles makes the hook component ideal for tiling. This is because the low profile reduces potential movement and the smooth surfaces reduce clothing snags during installation and handling.

However, further installation testing highlighted an unacceptable reduction in Shear strength between the loop component of the original Combination A/A1 fastener and the extruded hook component showing increased tile movement compared to the Combination A/A1. To improve the Shear Strength Applicant experimented with the lightweight knitted loop component of Combination B which to create a new hook-and-loop fastener specifically designed for tiling and herein referred to as Combination C.

Installation trials of Combination C were successful in that the extruded hook and higher than usual density lightweight knitted loop components addressed all of the Applicant's requirements with regard to the engagement properties of high pull strength, high shear strength, low peel strength as well as acceptable price point.

Thus, in a preferred embodiment of the invention, the hook component of the hook-and-loop fastener is of extruded plastics material, preferably polypropylene, and the loop component is preferably of light-weight knitted material, which is conveniently carried by a layer of plastics material. The plastics material of the loop component carrier layer is advantageously of Polyethylene Terephthalate (PET) which preferably has a thickness of 45 microns.

And, the low and smooth profiles provided by the extruded hook material guard against clothing snagging during tile installation.

The Applicant found that a hook component comprising a combination of extruded microscopic mushroom-shaped hooks tightly packed and moulded in rows produced widespread coverage over the entire surface of the hook component and a loop component comprising a dense arrangement of light-weight knitted loops ensured widespread cooperative engagement across the back surface of the ceramic tile.

Whilst the hook component used in Tac-Fast 443 has the disadvantage of adding to the thickness of the plaster board to which the hook component is fixed, the increase in thickness resulting from the application of the hook and loop components of the present invention to the wall surface and tiles is of negligible effect. In a preferred embodiment this negligible effect is due to the low and smooth profile and a thickness of about 1 mm and preferably less than 1 mm of each of the hook and loop components.

The product development cycle highlighted the importance of the glue and release liner elements as part of the complete hook-and-loop fastener system. Samples provided during installation testing were produced pre-glued with release liner. However, full manufacturing production of Combination C is envisaged with or without glue or release liner.

By way of example, SikaMelt 9209 pressure sensitive high tack glue was used on the Combination C samples and performed extremely well during installation trial but other suitable glues may be used.

And to obtain the requisite strength, the release liner is advantageously a PET film which may be about 36 microns thick.

In order that the invention may be more readily understood some embodiments in accordance therewith will now be described, by way of example, with reference to the accompanying photographs, in which:

DETAILED DESCRIPTION OF EMBODIMENTS OF THE INVENTION

Figure 1:
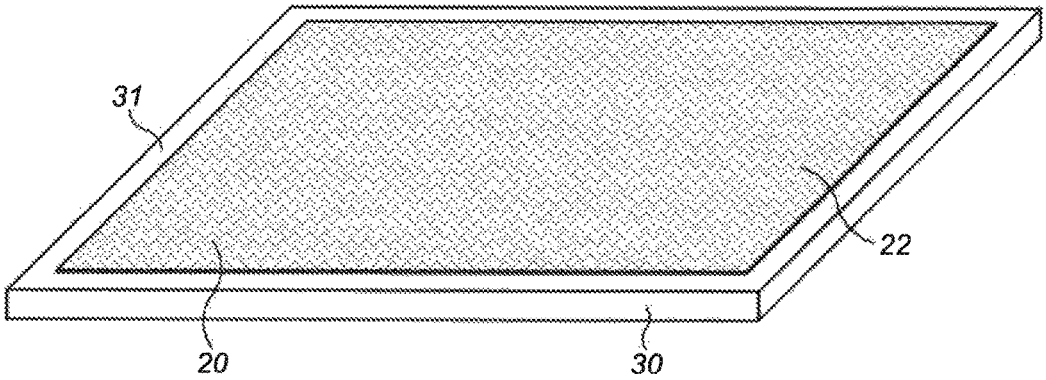
FIG. 1 is a rear perspective view of a large format ceramic wall tile bearing a first component of a hook-an-loop fastener according to an aspect of the invention.

FIG. 1 illustrates a wall covering in the form of a tile 30 that forms part of a wall covering system. The tile 30 comprises a rigid body 31. A first component 20 of a hook-and-loop fastener is fixable to the rigid body 31, and in the embodiment illustrated is more specifically shown fixed to the rigid body 31.

Figure 2:
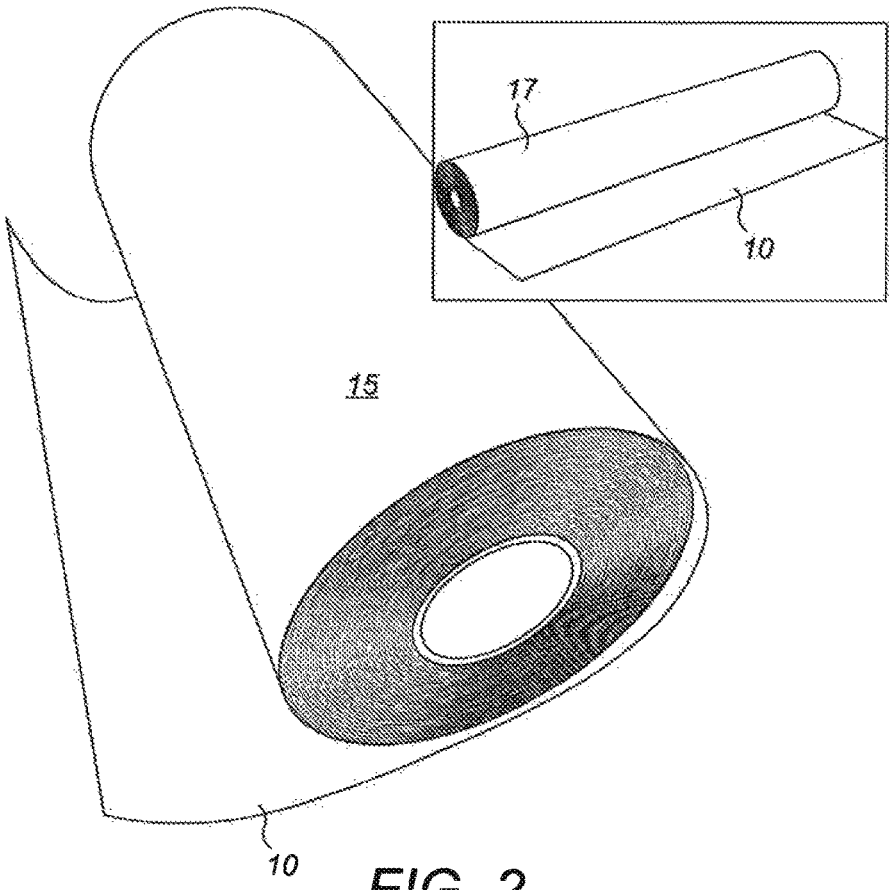
FIG. 2 is a perspective view of two rolls of a second component of a hook-an-loop fastener for applying to an underlying wall surface, which can be used in conjunction with the tile of FIG. 1 to provide a wall covering system according to another aspect of the invention.

FIG. 2 illustrates a second component 10 of the hook-and-loop fastener that, in use, is fixable to a vertical underlying surface defined by a wall (not shown). In this example, the second component 10 is supported on a backing sheet 17 that is rolled into a roll 15. The backing sheet has a pre-glued undersurface (not shown) that can be fixed to a wall surface.

In the embodiment shown, the first component 20 is a loop component that comprises a plurality of loop structures and the second component 10 is a hook component that comprises a plurality of hook structures. However, embodiments are also envisaged in which the first component 20 is the hook component and the second component 10 is a loop component.

In use, the second component 10 is fixed to the wall surface via the pre-glued backing sheet 17. The tile 30, with the first component 20 attached, is then pressed onto the second component 10 on the wall surface so as to engage the first and second components, 20, 10 of the hook-and-loop fastener. Engaging the first and second components 20, 10 causes the tile 30 to grip the wall, thereby fixing the tile in place on the wall.

As will now be explained by more detailed description of the hook and loop components 10, 20, the hook and loop components 10, 20 are configured to cooperate so as to provide a synergy between the physical properties of pull strength, shear strength and peel strength. In particular, the components 10, 20 are configured to provide a fastening having a pull strength and a shear strength that are high enough to hold the surface covering 30 in position on the vertical support surface, against the weight of the surface covering 30, but a peel strength that is low enough to allow removal of the surface covering 30 from the underlying surface by peeling the rigid body 31 away from the wall.

Referring to FIGS. 3 to 6, there is shown a hook-and-loop fastener of which a hook component 10 (FIGS. 3 and 4) and a loop component 20 (FIGS. 5 and 6) engagingly cooperate to fix wall surface coverings, in particular conventional ceramic tiles, (not shown), to underlying surfaces such as walls (not shown).

In the illustrated hook-and-loop fastener comprising the hook and loop components 10 and 20 the forces for holding a conventional ceramic tile to yet allowing removal of the tile from, an underlying support surface, are in synergy.

The engagement properties of the cooperating hook and loop components 10 and 20 of the fastener are such that there is synergy between the physical properties of pull strength, shear strength and peel strength, and this which synergy balances these physical properties.

Figure 3:
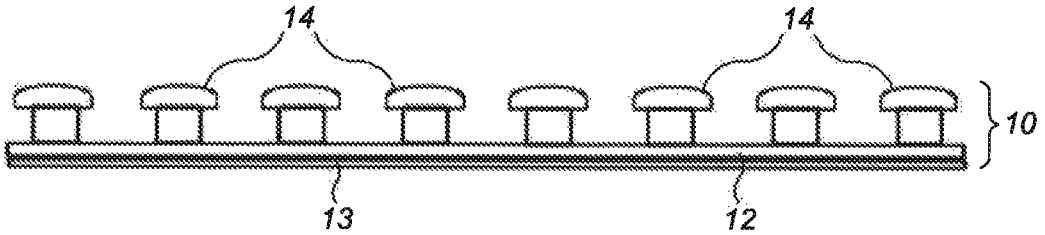
FIG. 3 is a side view of a portion of the hook component of the hook and loop fastener element of FIGS. 1 and 2.
Figure 4:
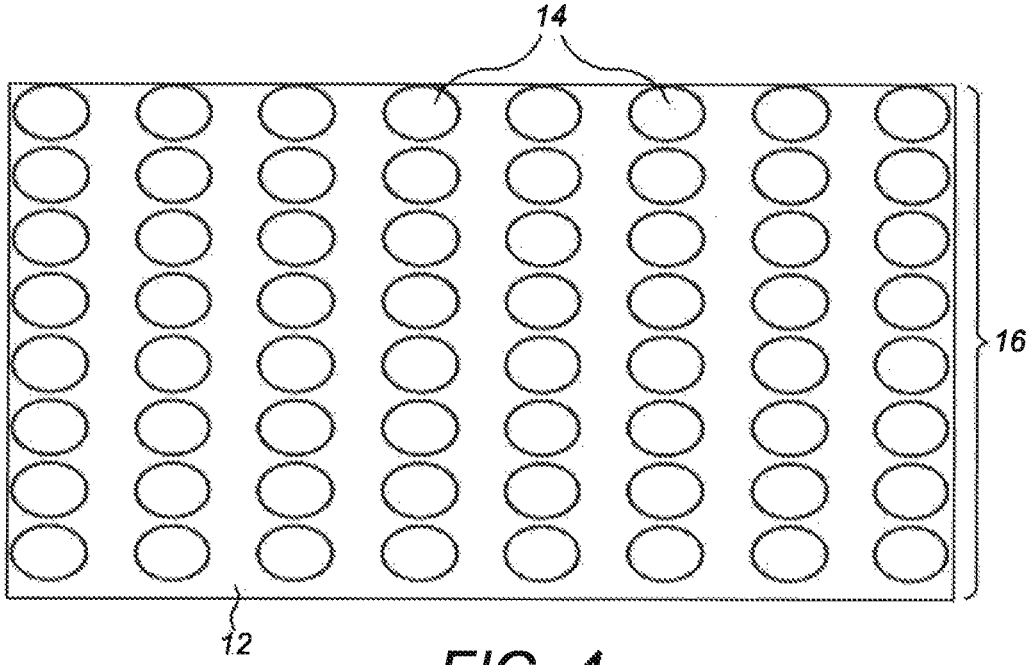
FIG. 4 is a top view of the hook component of FIG. 3.

The hook component 10 is made of an extruded moulding of plastics material which is of low and smooth profile and waterproof. As shown in FIGS. 3 and 4, the hook component 10 may be of polypropylene and has a base layer 12 with microscopic hooks 14 projecting therefrom and generally of mushroom shape, having a cylindrical stem and a domed cap of circular cross section that extends beyond the cylindrical stem in all directions. A glue layer 13 is provided on the under surface of the hook component 10, which can be used to fix the hook component 10 to a surface.

It is envisaged that shapes other than mushroom shapes may achieve the same synergistic result. For example, any shape including a relatively narrow stem supporting a relatively wide cap may achieve the same result. The cross section of the cap could be of any suitable shape, for example an oval, a square shape or a cross shape.

As can be seen more readily in FIG. 2, the microscopic mushroom-shaped hooks 14 are tightly-packed and moulded in rows 16, giving widespread coverage over the entire surface of the hook component 10. The mushroom-shaped hooks 14 are of low profile, and preferably have a height of approximately 0.42 mm above the base layer 12.

As is visible in FIGS. 3 and 4, the loop component 20 comprises a multiplicity of dense, lightweight, knitted low-profile loops 22 carried by a base layer 31. The base layer 21 is made of plastics material which is conveniently of Polyethylene Terephthalate (PET) and preferably has a thickness of 45 microns. The loops 22 preferably have a height of less than 0.41 mm, such that a total thickness of the hooks 14 and loops 22 is no greater than approximately 0.83 mm.

The dense arrangement of the loops ensures that widespread cooperative engagement occurs across the back surface of the ceramic tile. The low-profile nature of the loops 22 ensures that once the hooks 14 are trapped in the loops 22, the hooks 14 are held tightly and close to the carrier layer of plastics material, such that very little vertical and horizontal movement is possible between the hook and loop components. In this way, movement of the components 10, 20, and hence of the tile 30, generally in the plane of the tiles is strongly restricted. This is particularly advantageous as it avoids the position of the tiles 30 creeping over time, for example, under the weight of the tile 30, or during laying of the tiles.

The loop density and widespread engagement of the loops 22 with the hooks 14, and the low-profile nature of the hook and loop fastenings reduces vertical and horizontal movement resulting in a high shear strength. The mushroom shape of the extrusion hooks 14 allows bi-directional engagement with the loops 22 enabling a ceramic tile to be fixed in either portrait or landscape orientation without affecting pull strength, shear strength or peel strength.

The smooth mushroom-shaped extruded hooks 14 and low-profile loops 22 create an engagement property which provides relatively low engagement strength for each individual pair of cooperating hook and loop components 10 and 20, achieving the desired low peel strength. Although each individual pair of hook and loop components exhibits low engagement strength, the tightly packed microscopic hooks ensure widespread engagement across the entire surface leading to the desired high pull strength.

A critical factor in ensuring that the tile is fixed securely to the wall is to ensure that the shear strength of the hook and loop components can support a range of different tile weights. Typical weights of tiles of particular sizes are as follows:

| Tile size | Weight |
|---|---|
| 100 × 100 × 6.5 mm | 0.112 kg |
| 150 × 150 × 6.5 mm | 0.245 kg |
| 200 × 100 × 6.5 mm | 0.221 kg |
| 200 × 200 × 6.5 mm | 0.441 kg |
| 300 × 100 × 10 mm | 0.489 kg |
| 300 × 200 × 8 mm | 0.804 kg |
| 360 × 275 × 8 mm | 1.341 kg |
| 300 × 300 × 8 mm | 1.634 kg |
| 400 × 150 × 10 mm | 1.021 kg |
| 400 × 300 × 10 mm | 2.052 kg |
| 450 × 450 × 10 mm | 4.341 kg |
| 600 × 150 × 9 mm | 1.902 kg |
| 600 × 300 × 10 mm | 3.301 kg |
| 600 × 600 × 10 mm | 8.296 kg |
| 850 × 290 × 10 mm | 4.432 kg |
| 900 × 450 × 11 mm | 9.332 kg |
| 900 × 600 × 11 mm | 12.909 kg |
| 1000 × 160 × 11 mm | 3.754 kg |

The hook-and-loop fastener must be configures such that the shear strength of the fastener is greater than the shear force applied by the weight of the tile.

Horizontal or vertical movement should be minimised to avoid grout cracking after a tile installation has been completed. Horizontal and vertical movement is determined by the amount of play between individual hook and loop elements when the tile is fixed to the wall. The surface area of the tile will further define the amount of horizontal and vertical movement; in particular, this movement is reduced exponentially when the surface area of the tile is increased due to the increase in the number of individual hook-to-loop engagements. After a series of tests the applicant determined that horizontal and vertical movement for tiles with a surface area less than 300 mm by 300 mm should not exceed 2 mm, while horizontal and vertical movement for larger tiles with a surface area greater than 300 mm by 300 mm should not exceed 1 mm. The combined thickness of the hook and loop components is also a key contributor to lateral movement therefore low profile hook and loop products are a necessity.

To ensure tile removal is easy, two key factors need to be addressed. Firstly, the requirement of the invention is to connect two rigid surfaces (wall substrate and a rigid decorative covering) therefore the aggressive peel strength of most common hook and loop products would create a bond strength that was too strong for a person to physically separate. Instead, the peel strength must be relatively low.

A second key factor is to ensure that the decorative covering can be removed without being broken. The invention has been designed primarily for ceramic tile installation therefore breaking strength values are a key factor. Ceramic tile breaking strength standards are categorised by material type—B1A Porcelain tiles and BIII Monoporoso tiles. B1A Porcelain breaking strength standards are defined by material thickness: tiles with a thickness ≥7.5 mm must have a breaking strength not less than 1300N and tiles with a thickness >7.5 mm must have a breaking strength not less than 700N. BIII Monoporoso breaking strength standards are also defined by thickness: tiles with a thickness ≥7.5 mm must have a breaking strength not less than 600N and tiles with a thickness ≤7.5 mm must have a breaking strength not less than 200N. During testing the applicant found that BIII Monoporoso tiles would break repeatedly during removal when fixed with aggressive hook and loop products and the high breaking strength values of a B1A porcelain combined with aggressive hook and loop products prevented tile removal altogether. The breaking strength tests highlighted the need for a hook and loop combination with a low peel strength.

The low peel strength of the invention has therefore been developed to ensure that the peel force required to remove a decorative covering is a) low enough to prevent any damage to the underlying vertical wall, b) less than the force required to break the decorative covering of the rigid body and c) lower than the amount of force a typical person could feasibly apply. This ensures that the tile can be removed easily by hand, and without damaging the wall or the tile.

Figure 5:
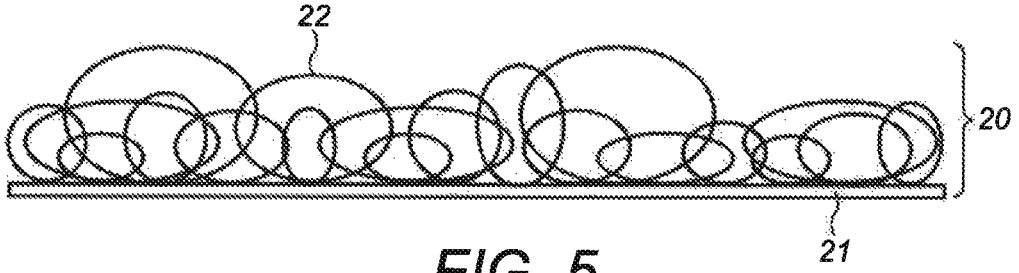
FIG. 5 is a side view of the loop component of the hook and loop fastener element of FIGS. 1 and 2.
Figure 6:
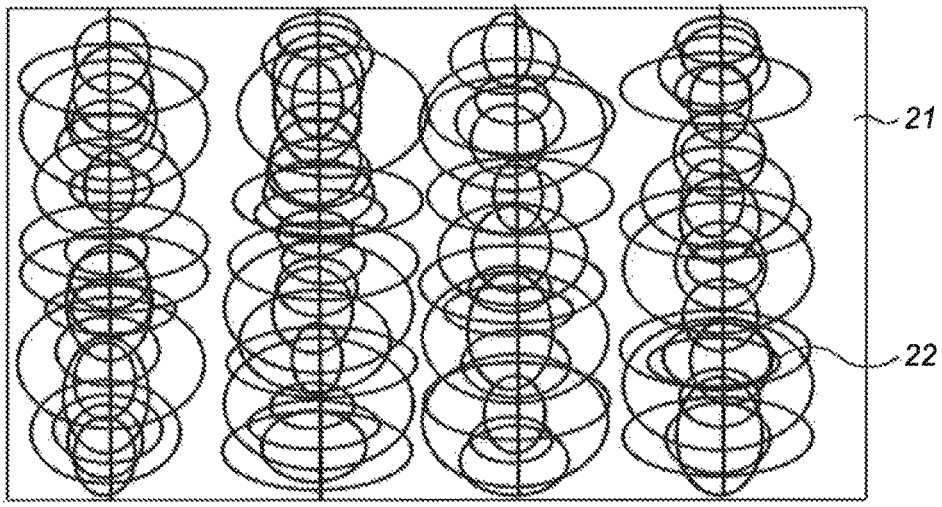
FIG. 6 is a top view of the loop component of FIG. 5.
Figure 7:
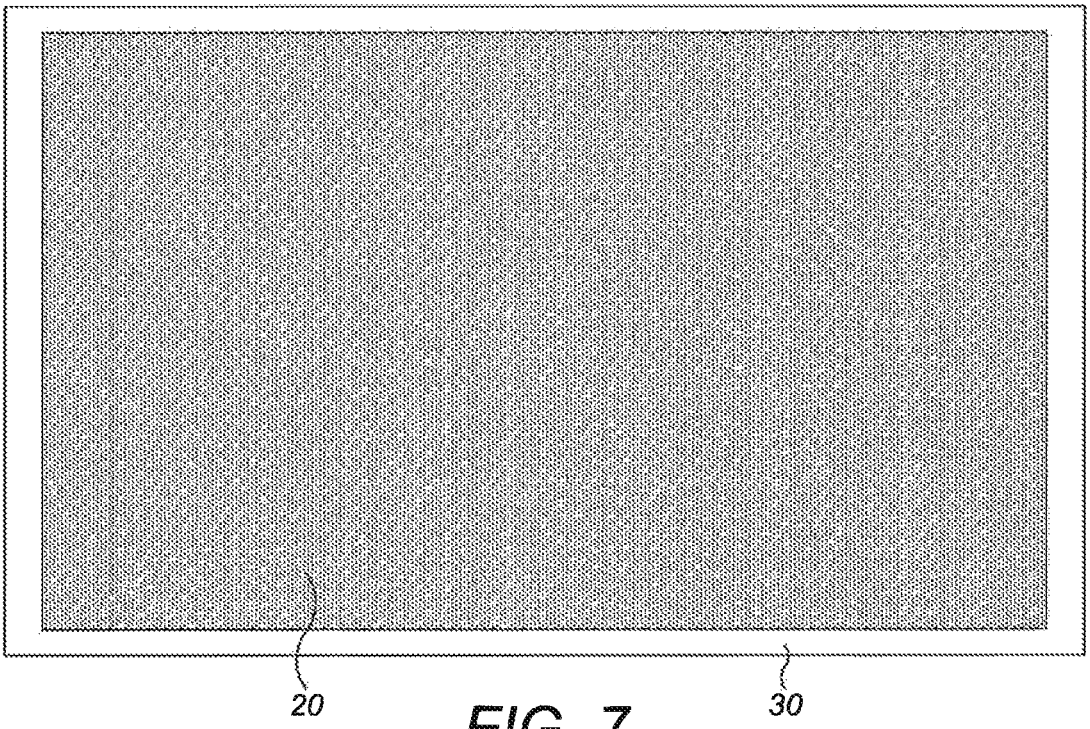
FIG. 7 is a plan view from below of the loop-backed ceramic tile of FIG. 5.

Referring to FIG. 5, the loop component 20 of Combination C is glued onto the back of a ceramic tile during manufacture of the tile to form a loop-backed tile 30.

The extruded hook component 10 (Combination C) may be supplied in the larger of the two hook rolls 15 as shown in FIG. 2. Alternatively, the hook component 10 may be supplied in the smaller (retail sized) of the hook rolls 17 shown in FIG. 2.

The installation process consists of two phases. The first phase is to apply the glue-backed hook component 10 onto the surface 32 of the wall. The second phase is to fix the loop-backed ceramic tiles 30 onto the surface of the wall 32 by attaching them to the hook component.

Figure 8:
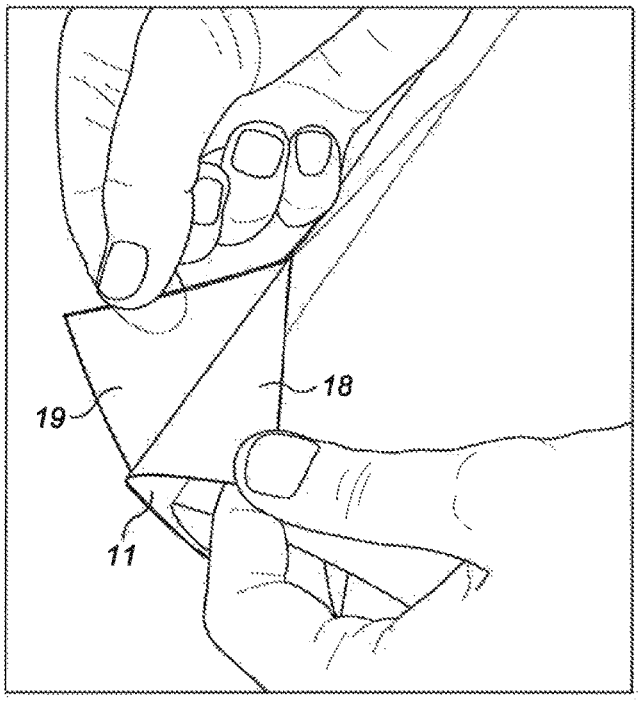
FIG. 8 shows the peeling action to separate the release liner from the hook component.

The first phase of applying the glue-backed hook component 10 to the wall surface 32 consists of four steps. As shown in FIG. 8, the first step is to separate the top edge section of the release liner 18 from the glue-backed element of the hook component 19. To simplify the peeling process the release liner 18 features an oversized lift edge 11 on both sides of the hook component as shown in FIG. 8.

Figure 9:
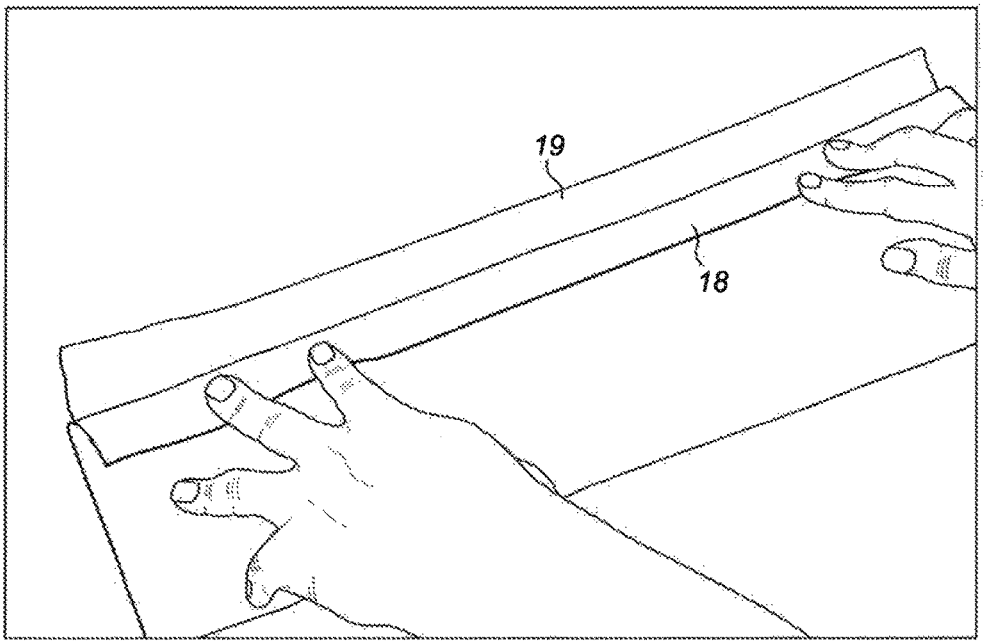
FIG. 9 shows the hook component with top section of release liner peeled back and folded.
Figure 10:
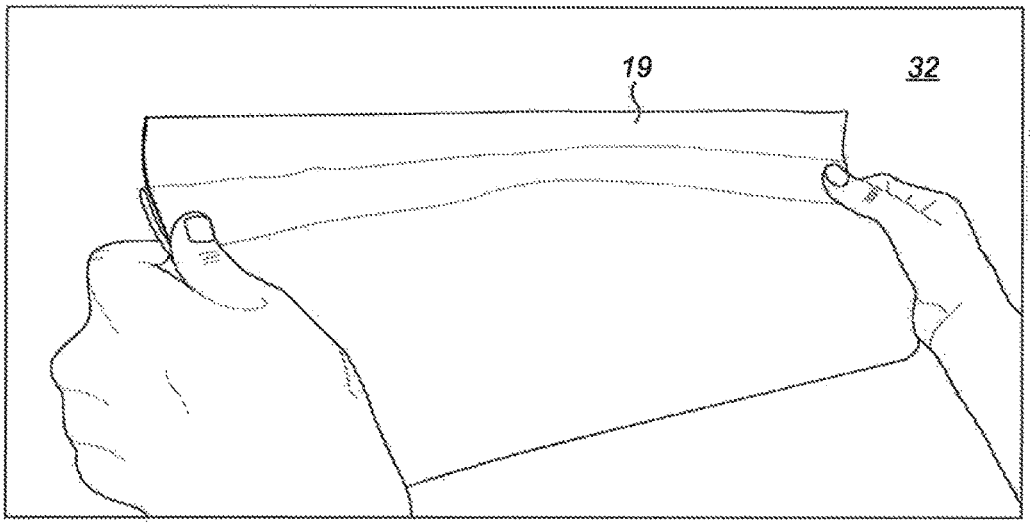
FIG. 10 shows the application of the top section of the hook component to the underlying wall surface.

FIG. 9 shows the second installation step where the release line 18 is separated along the entire top edge and folded back to reveal the top edge section of the glue-backed hook component 19. The third installation step is shown in FIG. 10 where the top edge section of the glue-backed hook component 19 is pressed into place on the surface 32 of the wall.

Figure 11:
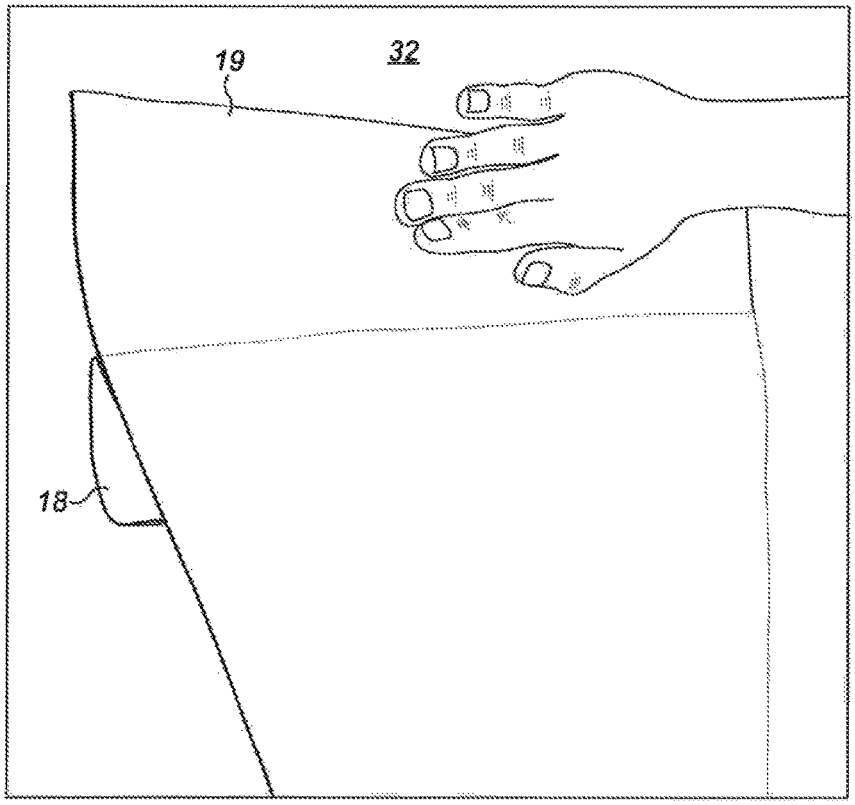
FIG. 11 shows one way of carrying out the application of the hook component to an underlying support surface by hand.
Figure 12:
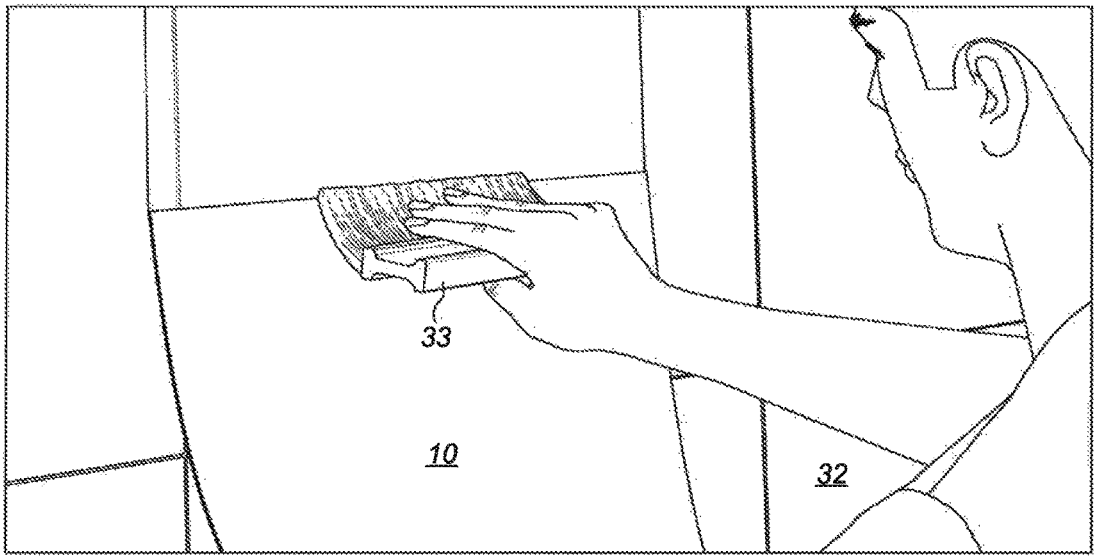
FIG. 12 shows another way of carrying out the application of the hook component to an underlying support surface using a decorating brush.
Figure 13:
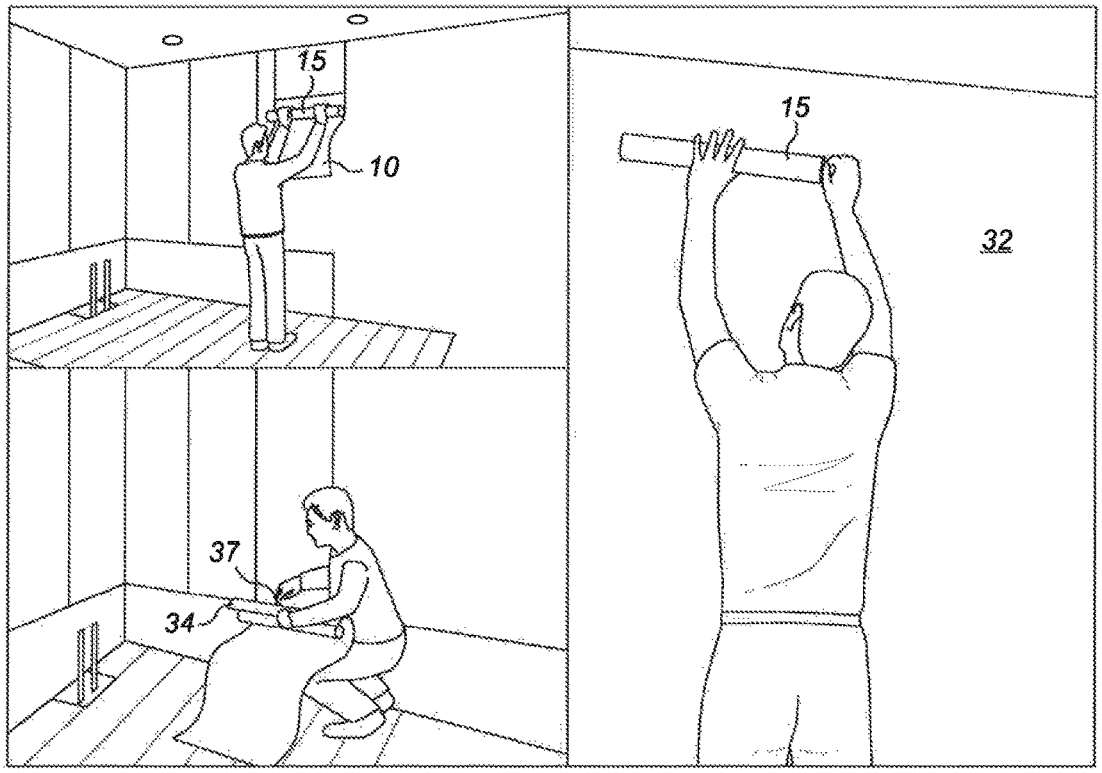
FIG. 13 shows the application of hook component to an underlying wall surface, from either of the rolls shown in FIG. 2.

FIG. 11 shows the fourth installation step where the remaining section of release liner 18 is peeled away from the glue-backed hook component in a continuous movement as the operator smooths the glue-backed hook component 19 onto the surface 32 of the wall. FIG. 11 shows the smoothing action using the operators hand and FIG. 12 shows an alternative smoothing method using a decorating brush. As shown in FIG. 13 the simultaneous action of peeling off sections of release line 18 and smoothing sections of glue-backed hook component onto the surface 32 of the wall is repeated until the operator reaches the bottom of the wall. At the bottom of the surface 32 of the wall the hook component 10 is cut to length from the roll 15 using a sharp blade 37.

Figure 14:
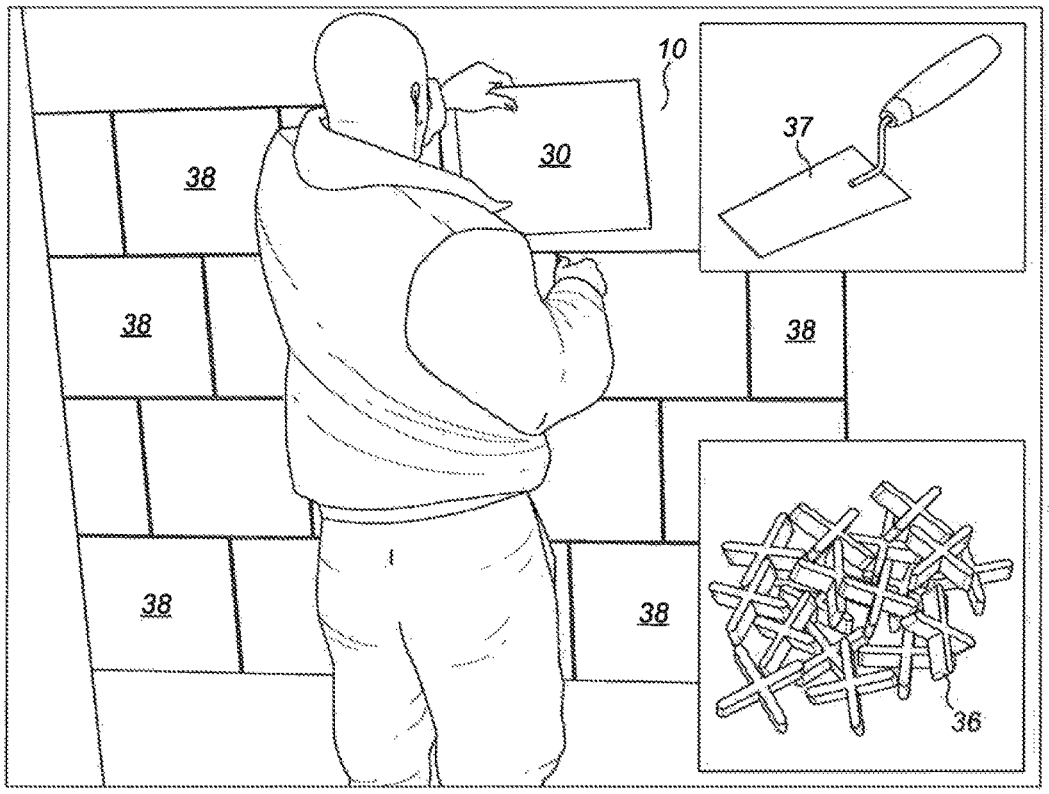
FIGS. 14 and 15 show the application of the loop backed large format ceramic tiles of FIG. 1 to the hook component applied to the underlying wall surface as shown in FIGS. 10, 11, 12 and 13.
Figure 15:
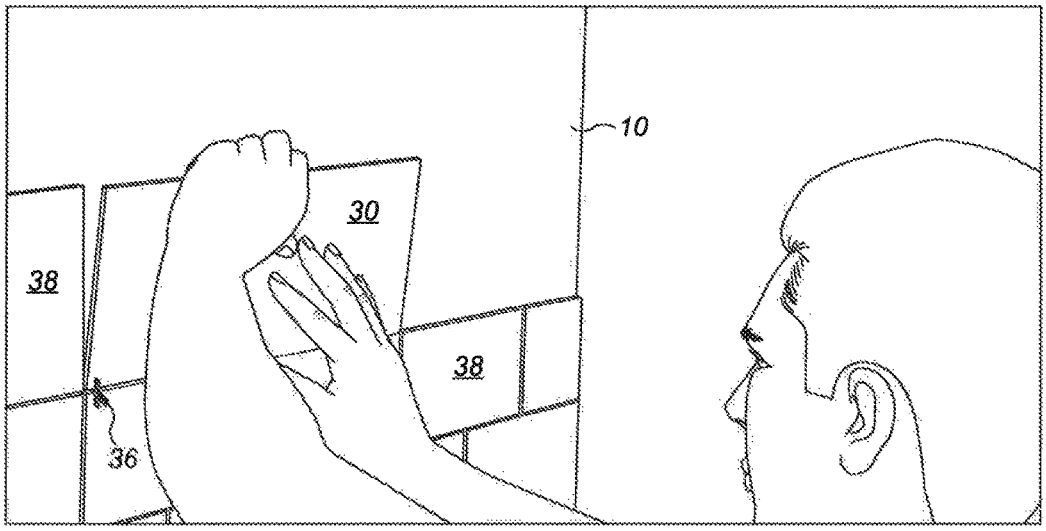

FIGS. 14 and 15 demonstrate the second installation phase where the loop-backed tiles 30 are fixed to the hook component 10 on the wall surface 32. Loop-backed tiles 30 are pushed into position to ensure engagement of the loop and hook components 20 and 10. As per traditional fixing, the loop-backed tiles 30 are positioned using tile spacers 36. A trowel tool 37 can be used to remove and reposition a hook-and-loop fastened tile 38.

Figure 16:
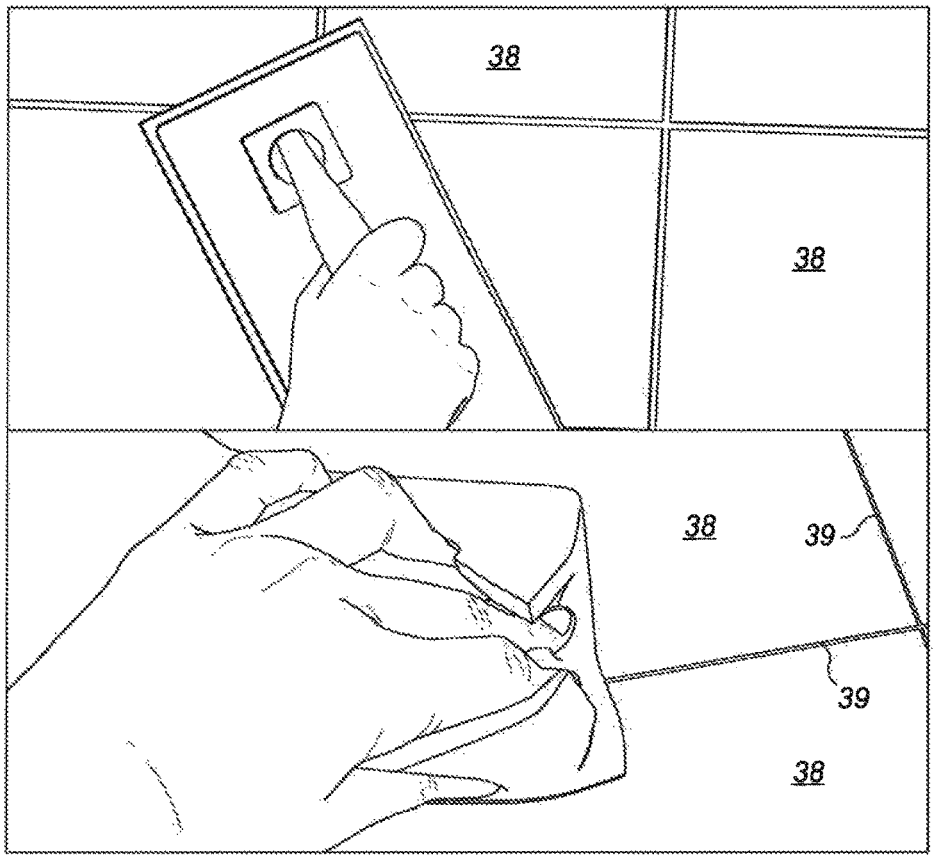
FIG. 16 shows the application of grout to complete the installation process of the loop backed large format ceramic tiles of FIGS. 1 and 2.

In the third and final step shown in FIG. 16, grout is applied between, and surrounding, the hoop and loop fastened tiles 38 using the traditional method, with the applied grout being indicated at 39.

To cater for wet area installations the invention includes a waterproofing solution that will now be described with reference to FIGS. 19 to 25.

Figure 17:
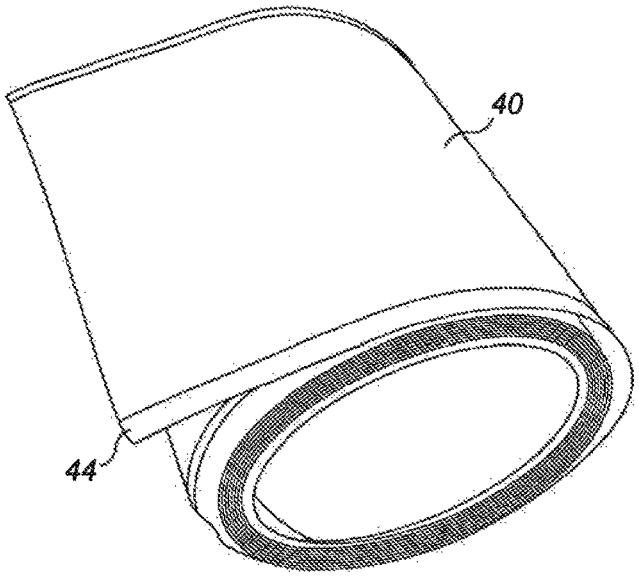
FIG. 17 is a perspective view of a tanking roll component for use in the wall covering system.
Figure 18:
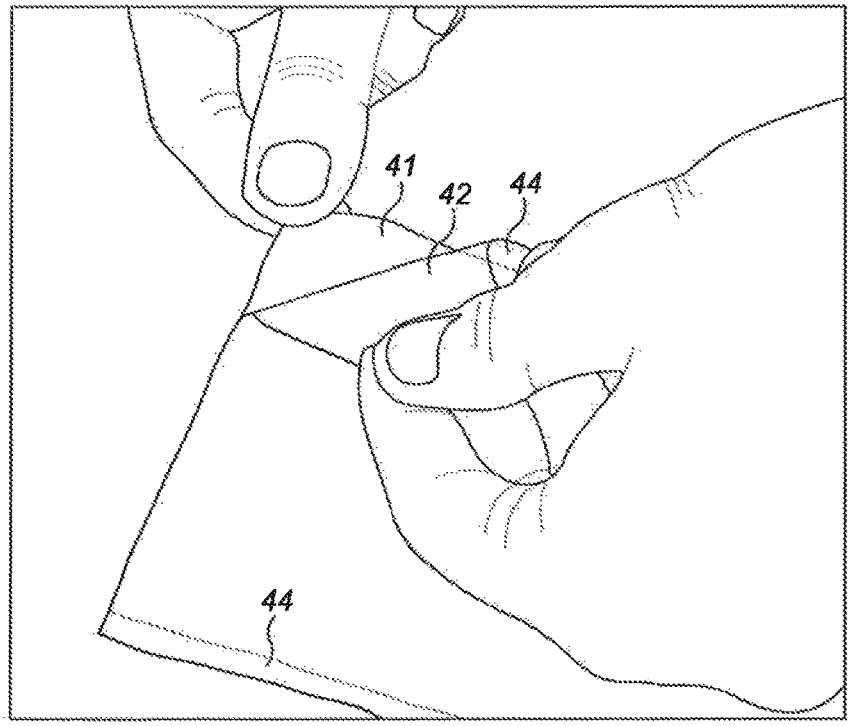
FIG. 18 shows the peeling action to separate the right-hand side of a spliced release liner from the tanking roll component of FIG. 17.

The waterproofing solution consists of a 100 mm wide tanking roll component 40 shown in FIGS. 17 and 18. The tanking roll 40 consists of two elements: a glue-backed waterproof tape 41 and a release liner 42, 43.

Figure 19:
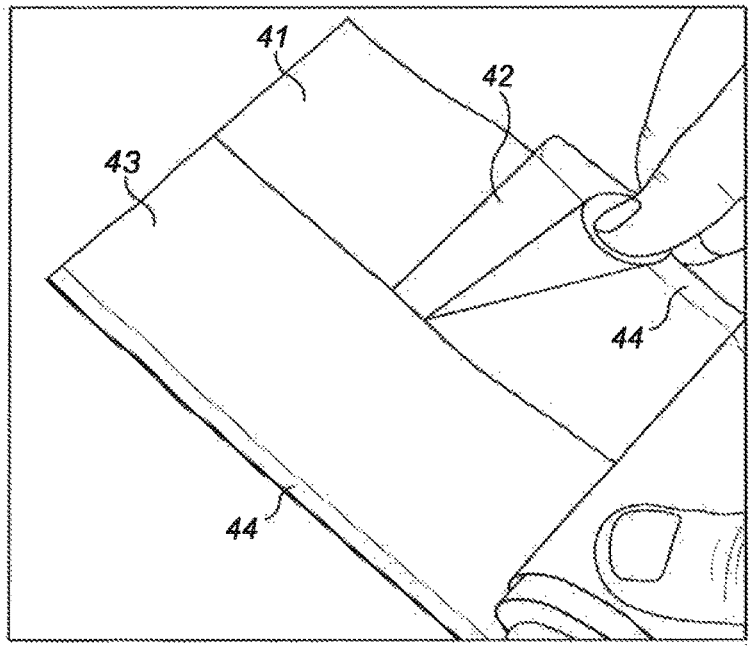
FIG. 19 further demonstrates the peeling action showing the right-hand side of the spliced release liner being separated from the tanking roll component whilst leaving the left-hand side of the release liner attached.
Figure 20:
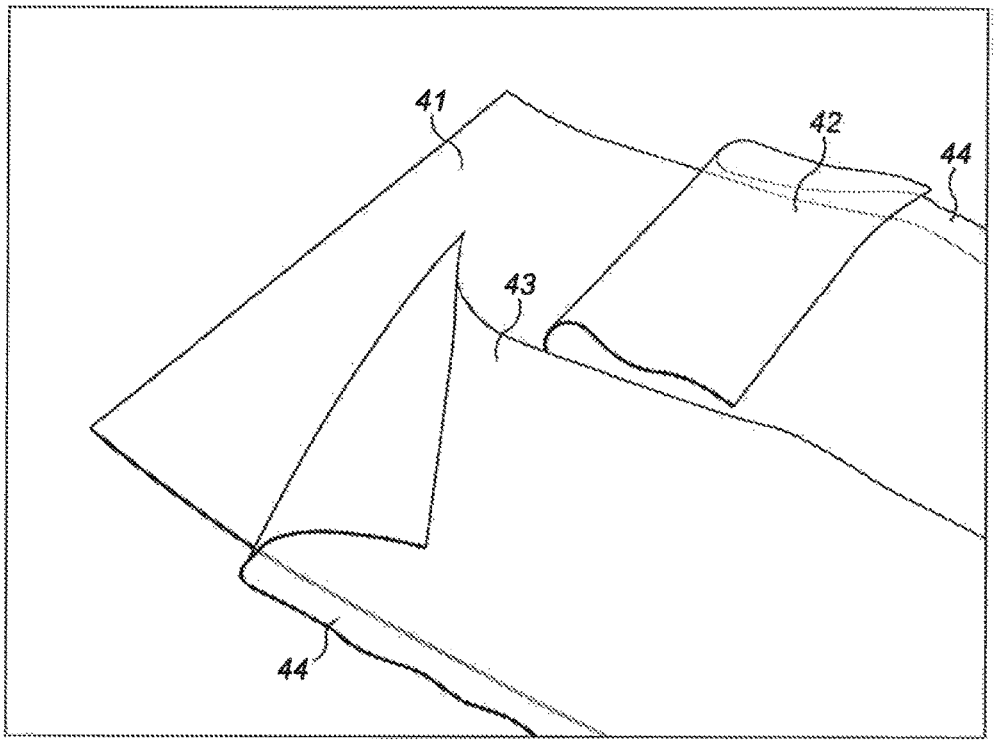
FIG. 20 shows the tanking roll component with both left-hand and right-hand sides of the spliced release liner partially peeled.

As can be seen in FIGS. 19 and 20, for ease of installation the release liner consists of separate right-hand 42 and left-hand 43 sections which can be peeled back and detached separately. The peeling action is further simplified by an oversized lift edge 44 on both sides of the tanking roll component. The separate right-hand and left-hand components 42, 43 also ease installation in corner areas 45 of the wall surface 32.

Figure 21:
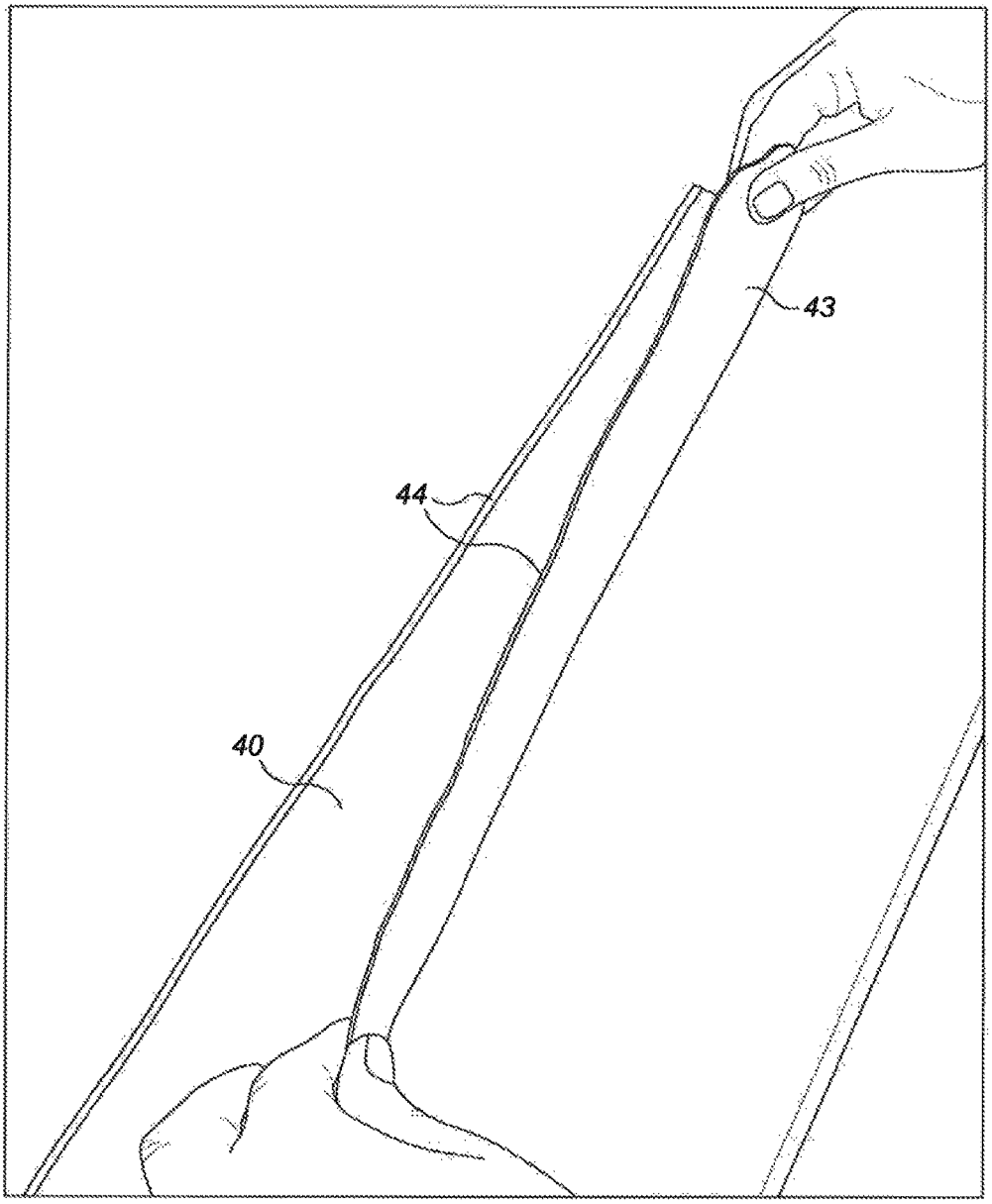
FIG. 21 shows the folding action of the tanking roll component.
Figure 22:
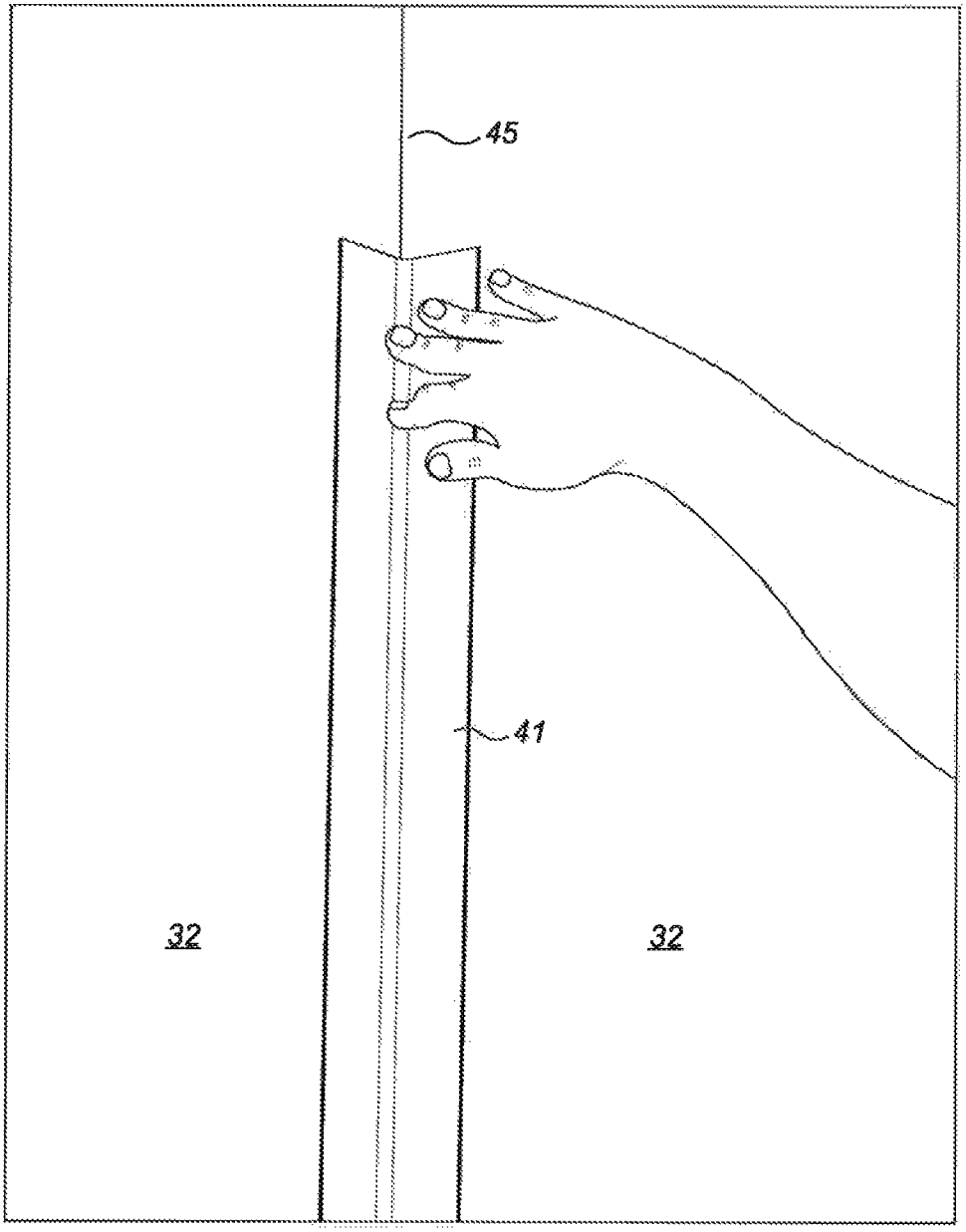
FIG. 22 shows the folded tanking roll being installed onto a corner section of a wall.
Figure 23:
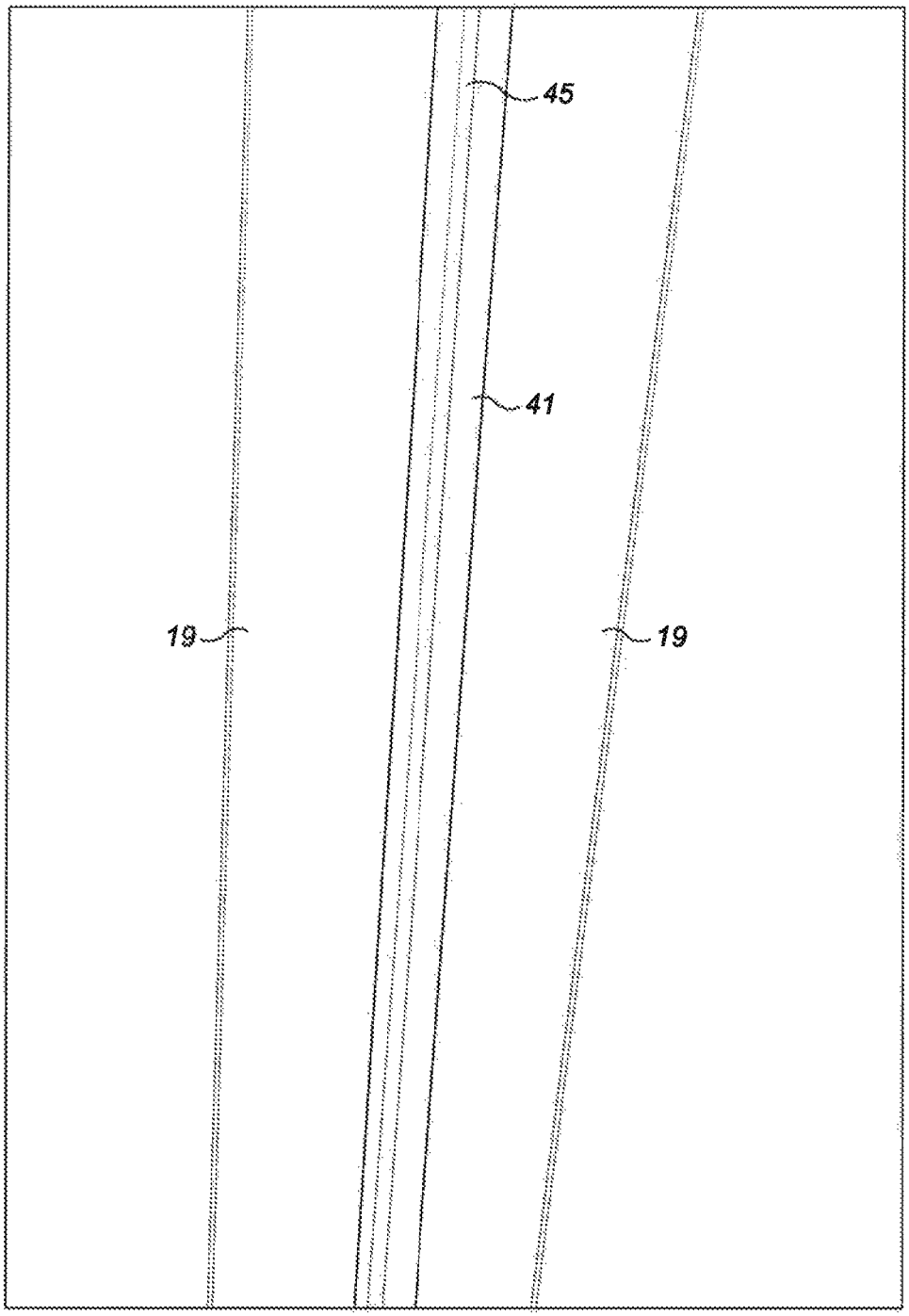
FIG. 23 shows the hook component overlaid onto the tanking roll component after it has been installed on a corner section of a wall.

FIGS. 21 to 22 show the installation of the tanking roll 40 at a corner region where two perpendicular walls meet. As shown in FIG. 21, a section of tanking roll 40 is folded in preparation for installation. The right-hand and left-hand sections 42, 43 of the release liner can be peeled away separately and, as shown in FIG. 22, the operator applies the folded glue-backed tanking roll component 41 to each plane defined by the two walls that meet at the corner. To make a watertight bond the glue-backed hook component 19 is overlaid on top of the glue-backed tanking roll component 41 as shown in FIG. 23.

Figure 24:
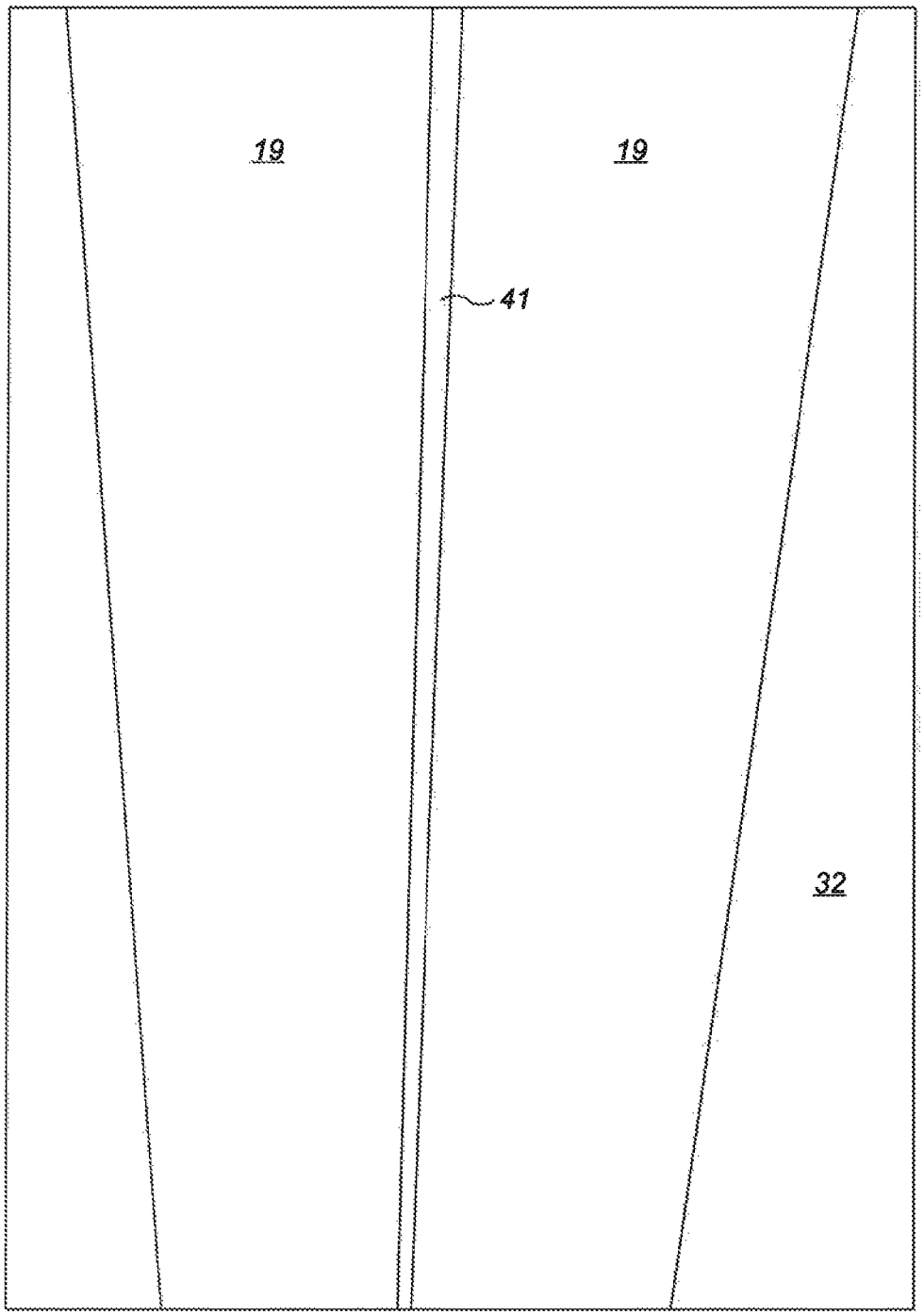
FIG. 24 shows the hook component overlaid onto the tanking roll after it has been installed on a flat section of a wall.

FIG. 24 shows a tanking roll installation on a flat wall surface 32. When installed onto a flat wall the right-hand and left-hand sections 42, 43 of the release liner can be peeled off simultaneously. After peeling off the sections of release liner the glue-backed tanking roll component 41 is smoothed onto the wall.

Figure 25:
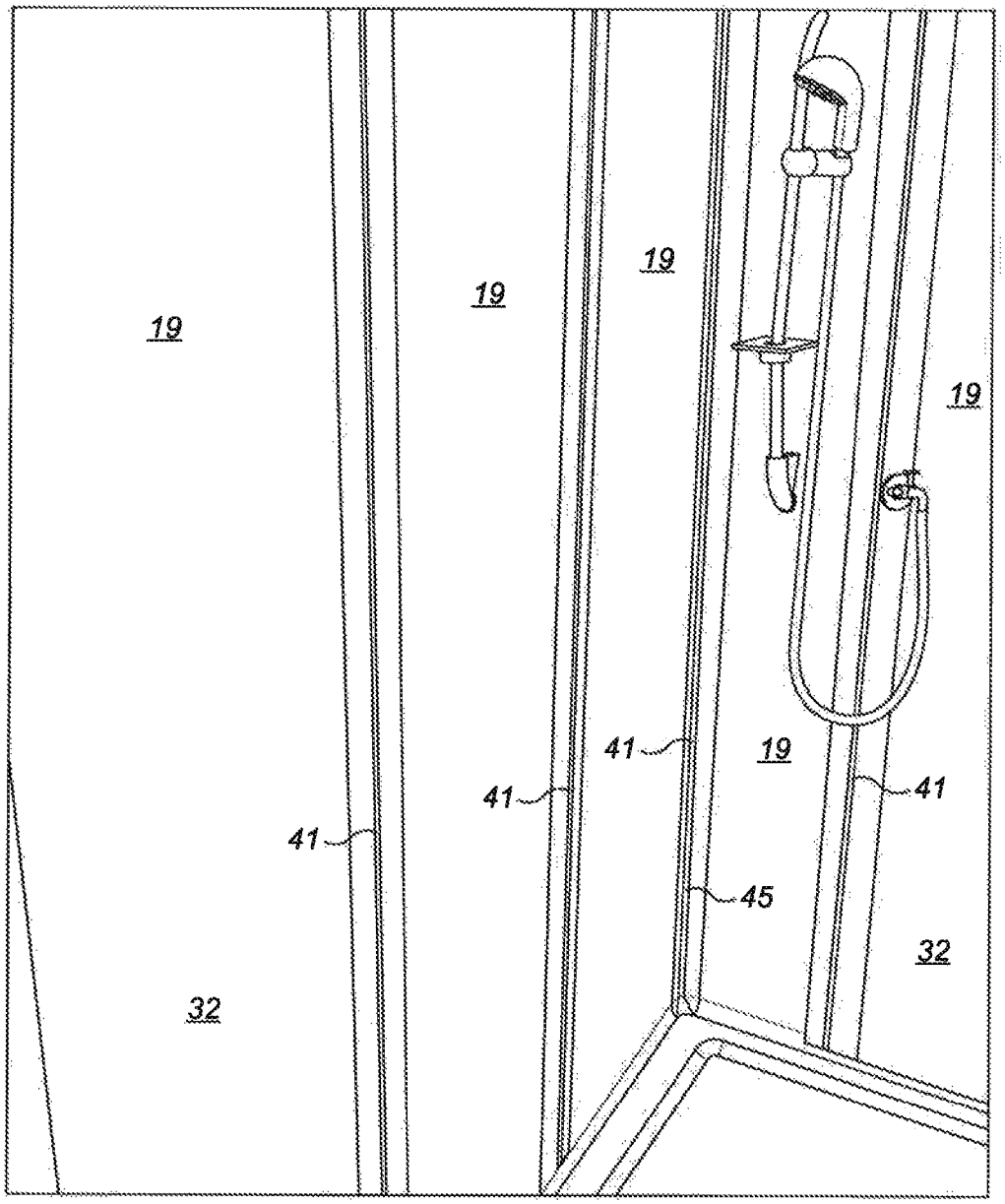
FIG. 25 shows a full waterproof installation where multiple sections of hook component overlay multiple strips of the tanking roll component.

As shown in FIG. 25, once the tanking roll 41 has been applied to the wall, the tanking roll 41 is overlaid with sections of glue-backed hook component 19 on the flat wall surfaces 32 and the corner areas 45. Once the glue-backed hook component 19 has been applied, the wall surfaces 32 are ready to receive the tiles 30.

The Applicant carried out pull, shear and peel strength tests and time trials on hook and loop component Combination C fastened to conventional large-format ceramic tiles, which were of the Applicant's own devising and not Industry Standard, with the following results.

Pull Strength Test (Large Format Ceramic Tiles)

The Pull Strength Test measures the force required to pull a hook and loop component fastened tile away from the wall surface.

Figure 26A:
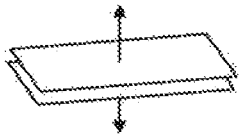
FIG. 26*a* is a schematic of the forces applied during a Pull Strength Test.
Figure 26B:
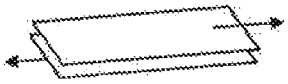
FIG. 26*b* is a schematic of the forces applied during a Shear Strength Test.
Figure 26C:
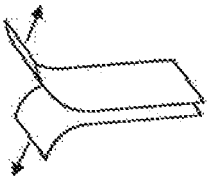
FIG. 26*c* is a schematic of the forces applied during a Peel Strength Test.
Figure 26:
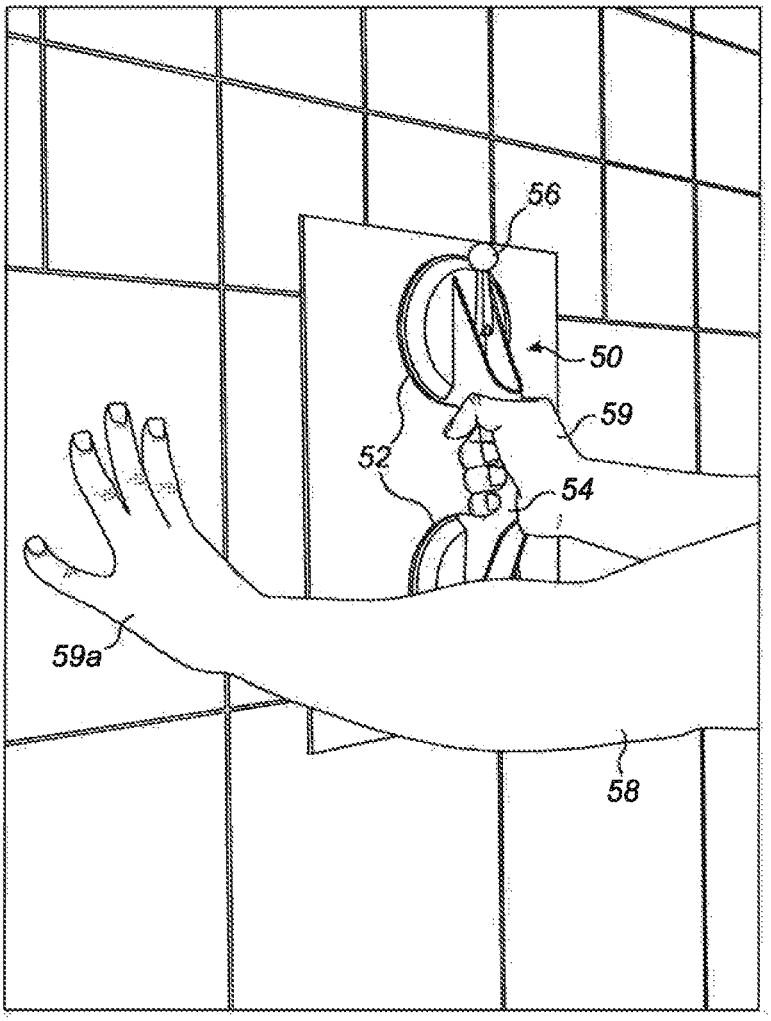
FIG. 26 shows the application of a Pull Strength Test of hook and loop component fixed large format ceramic tiles and is carried out in accordance with one embodiment of the invention.

An application of the Applicant's Pull Strength Test is shown in FIG. 26, and the forces applied during the Pull Strength Test are illustrated schematically in FIG. 26*a*. The Pull Strength Test uses a suction device 50 having a pair of suction cups 52, joined by a handle 54 having a suction valve 56 so a vacuum can be produced in the suction cups. The suction cups 52 are applied to a loop-backed tile 30 which has been fastened to the hooks 14 of a hook component 10 adhered to the tiles 30 applied to the wall, the valve 56 is opened and air is sucked from the suction cups to produce the requisite holding vacuum. A fitter 58 pulled on the vertically arranged handle 54 of the suction device 50 with one hand 59 and exerting counter pressure against the wall with his other hand 59*a* but failed to pull the Combination C hook-and-loop fastened tile 30 from the wall.

Shear Strength Test

Figure 28:
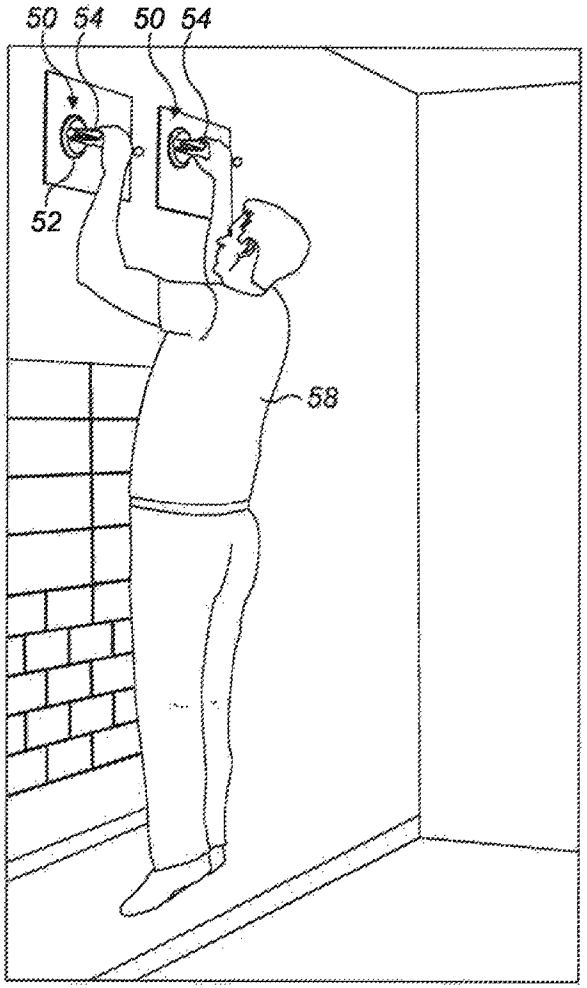
FIG. 28 shows how one embodiment of a Shear Strength Test is carried out in accordance with one embodiment of the invention.

The Applicant's Shear Strength Test is shown in FIG. 28, and the forces applied during the Shear Strength Test are illustrated schematically in FIG. 26*b*. In the Shear Strength Test, two suction devices 50 are applied to two loop-backed tiles 30 respectively which have been fastened to the hooks 14 of a hook component 10 applied to the wall, with the two handles 54 horizontal. The valves 56 are opened, and air is sucked from the suction cups 52 to hold the suction device to the tiles 30. In this test, the fitter 58 uses his two hands to hold onto the respective two handles of the suction device 50 and then pulls himself up into the illustrated position in doing which he is hanging and supporting his entire weight from the suction device 50 through the hook-and-loop fastened tiles of Combination C. The Applicant knows from this test that the hook-and-loop fastened tiles of Combination C are capable of withstanding a weight of 80 kg (12.5 Stone), and hence a vertical (Shear) force of approximately 785 N.

Peel Strength Test

Figure 27:
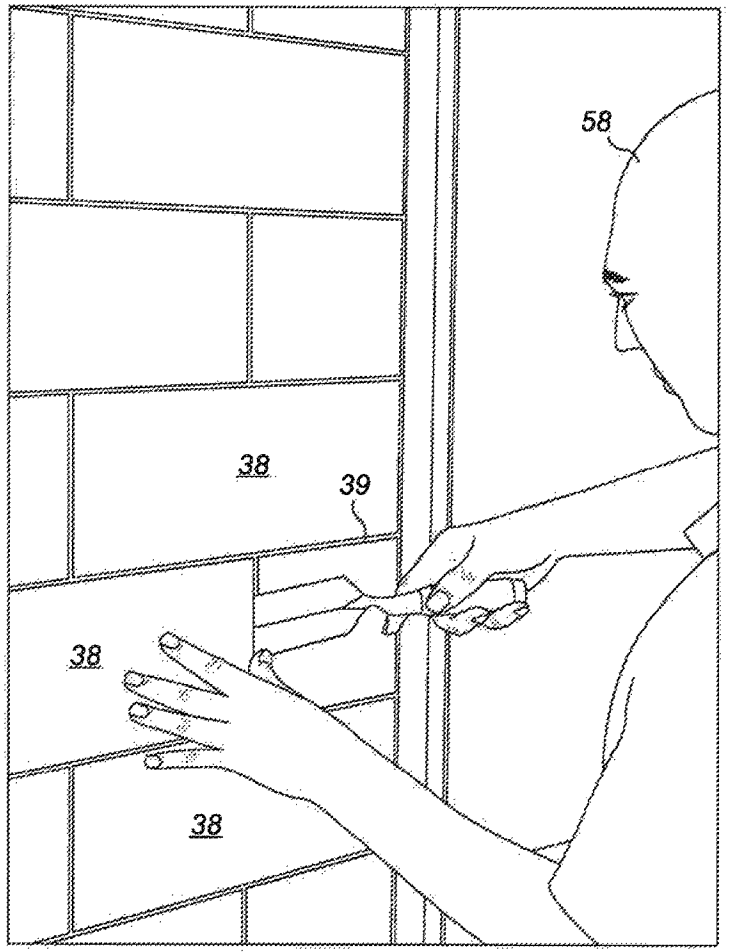
FIG. 27 shows how a Peel Strength Test may be carried out before grouting in accordance with one embodiment of the invention.

FIG. 27 shows how the Applicant's Peel Strength Test was carried out, and FIG. 26*c* illustrates schematically the forces applied during the peel strength test. The Peel Strength Test was carried out without grout 39 being applied between, and surrounding, the hook-and-loop fastened wall tiles 38 using Combination C. The free end of a trowel tool 60 is inserted (as shown) between the empty grout gap 39 and the tile and behind the loop backing of the tile 38 between the hook component on the wall and the loop component on the tile 38 and simply levered upwards utilising a prising movement to disengage the loop component easily from the underlying hook component. The ease and simplicity of this levering and turning movement shows that the Peel strength of Combination C is low.

Figure 29:
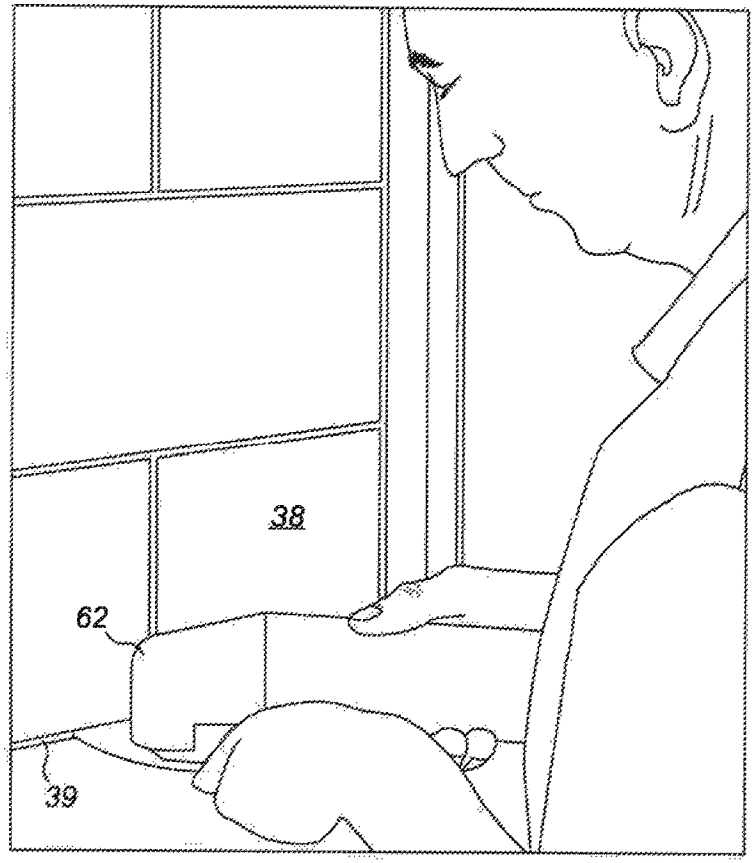
FIG. 29 shows how grout around the edge of a single tile is removed using an oscillating blade tool.
Figure 30:
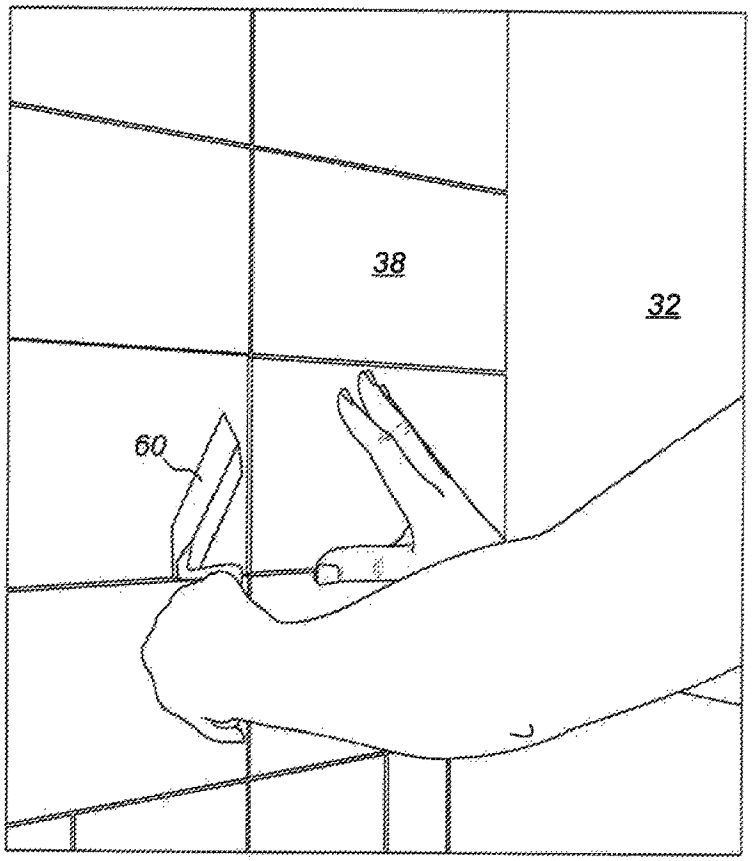
FIG. 30 shows how, after grout has been removed around a single tile, the remaining grouted tiles can be removed from the wall using a trowel tool.

As shown in FIGS. 29 and 30, Peel Strength Tests were also carried out after grouting was applied. As shown in FIG. 29, a single hook and loop Combination C fastened tile may be removed as the first tile 38 of all the tiles 38 on the wall surface 32 for re-tiling after grout 39 has been removed with a tool 62 having a grout-removing oscillating disc 64.

Water Penetration Test

Working with a UKAS accredited testing house the invention has been subjected to a series of water penetration tests to establish regulatory compliance performance of the hook and loop system and make direct comparisons with the performance of conventional cementitious based tile adhesive. Tiles fixed to plasterboard panels via both hook and loop and cement based adhesive were subjected to various testing cycles using a Hydrothermal Chamber. The panels were subjected to BS EN tensile and shear strength adhesion tests both before and after each testing cycle. The conditioning cycles subjected the boards to the following conditions: 20 minutes water spray at 40° C., 20 minutes dehumidifying and 20 minutes at ambient humidity/temperature. The testing panels were subjected to conditioning for a period of 28 days and a total of 675 cycles. The panels were inspected on a daily basis and on completion of the cycle the adhesion tests were repeated both wet and after drying and a comparison of the results were made with control samples.

Key points from the testing results are as follows:

The hydrothermal chamber tests measured water penetration levels over a 28 day period under extreme conditions and the results showed that although the daily visual inspections revealed areas of shading on both walls there was no damage to either wall or evidence that water had penetrated to the rear of the plasterboard. A tiled layer can never be considered as a completely impervious layer even when traditional water resistant adhesive and grouts are used. Hydrothermal cycling results in an extreme environment with a tile system constantly subjected to moisture and high humidity which allows little or no time for drying. Moisture penetrates the grout lines and is absorbed into the body of the tile resulting in equal amounts of shading in the tile body on both of the fixing systems. Removing tiles from the walls revealed moisture in the tile adhesive and between the hook and loop but in both instances the plaster board remained dry. Drying of both walls resulted in a complete reversal of the shading effect.

A comparison of the tensile values obtained before and after hydrothermal cycling indicates that there has been little or no degradation of the bond between the tile and the substrate after testing. Tensile values obtained for the hook and loop system using both gloss and matt tiles were in fact found to be higher after hydrothermal conditioning. The higher value of the tensile test arises because the loop material is known to shrink when wet, which results in a higher bond strength as the loop shrinks around the hook.

The tensile strength of the hook and loop system was found to be lower than traditional tile adhesive. However, the tensile strength was intentionally designed to be lower since a lower peel strength is necessary to allow the tiles to be removed and exchanged without the need to replace the hook material or plasterboard.

At present there are no standards which relate to the tensile strength of tile installations in situ, under perfect laboratory conditions a traditional cementitious adhesive is expected to obtain a tensile value in the region of 0.5 $N/mm^2$. The hook and loop system achieved a value lower than this but the average value of 0.023 $N/mm^2$ would mean that a single tile would be able to support a weight of 234 kg or the equivalent of 2.8 average adult males. Such a strength is ample to keep the tile in place on the vertical surface under the sorts of stresses that would be applied during use of the tile, for example by a person leaning on the wall.

Hydrothermal cycling tests represent accelerated climate conditioning resulting in accelerated aging. Completion of 675 cycles in the chamber can be said to equate to approximately 10 years' service under normal domestic conditions.

Fire Testing

Working with a UKAS accredited fire testing company the invention has been evaluated using European Standard EN 13501-1 which provides the reaction to fire classification procedures for all products and building elements. Fire classifications are A1, A2, B, C, D, E and F with A1 being the highest or best rating and F being the lowest rating (no performance determined). Currently, ceramic tiles have the highest fire rating under CE marking of A1 (classified without testing) due to the nature of tiles being inert having been fired to 1130 C.

The UKAS testing house recommended a target classification of B for the hook and loop fixing system. Group B is for products and systems suitable for all buildings with a few exceptions e.g. marine environments and rail carriages. Exceptions such as marine environments are subject to further toxicity evaluations therefore acceptance could also be achieved with the successful completion of further tests.

The testing process was conducted using the maximum number of joins between tiles in the system, i.e. utilising the smallest 10×10 cm tiles. By selecting a tile size that maximises the number of joins between the tiles, this test would cover all field tiles 10×10 cm and above.

Two categories of tests were performed to obtain classification B to EN13501-1:

Single Burn Item Test EN 13823:2010

The SBI test is the main reaction to fire test for building products and investigates the response of a product in a corner configuration when it is exposed to a thermal attack typifying fire involving a single burning item. 1.5 m by 1.0 m panels will be constructed in a corner configuration and exposed to a single heat source to assess the fire performance of the combined hook and loop elements measuring time to ignition, heat release, spread of flame, smoke production rate and formation of flaming droplets/debris.

Ignitability Test EN ISO 11925-2:2002

This test method measures the ignitability of building products when exposed to a small flame. The test takes place inside a draught free test chamber where the test specimen is mounted vertically. The test specimen is subjected to edge and/or surface exposure from a gas flame. During the test, time of ignition, burning droplets and whether the flames reach the top marking of the test specimen within a prescribed time period, is registered. Each element of the hook and loop system is tested separately to calculate the individual smoke production and flame droplet values. The values are adjusted based on the mass of each element within a square meter area and combined to produce a total value for the whole tiling system. The total value determines the classification.

Time Trials

Time trials were conducted on a typical installation of hook-and-loop fastened conventional ceramic tiles by comparing ready mix adhesive, rapid set adhesive and Applicant's hook and loop component Combination C.

In this time trial, Applicant carried out tile fixing tests by tiling a typical size bathroom wall, with a 36×27 ceramic tile in a brick bond fashion), with the following results:

| | Hook-and-loop fastener | Rapid Set | Ready Mix |
|---|---|---|---|
| Applying hook component roll to a wall surface | 24 mins | — | — |
| Preparation/Mixing | — | 5 mins | — |
| Tile Fixing | 34 mins | 51 mins | 51 mins |
| Total | 58 mins | 56 mins | 51 mins |
| Drying Time | — | 60 mins | 180 mins |
| Grouting Time | 10 mins | 10 mins | 10 mins |

If excluding drying time, the Applicant's hook and loop Combination C took marginally longer to fix to the wall surface than conventional adhesives. However, significant time savings arise as a result of the fact that there is no drying time, which means that the Applicant's hook and loop Combination C can be grouted immediately. This is particularly important in time sensitive applications when tiling as a wet trade is on the project critical path.

The Applicant has found that a particularly advantageous combination of pull strength, shear strength and peel strength, which provides for the tiles to be particularly securely fixed to the wall whilst also allowing for particularly easy removal of the tile by peeling is as follows:

Pull strength: approximately 1.5 N/cm$^2$, measured according to European Standard EN 12 242;

Shear strength: approximately 30 N/cm$^2$ measured according to European Standard EN 13 780; and Peel strength: approximately 0.6 N/cm$^2$ measured according to French Norm NF G 91 103.

The Applicant concluded that its hook and loop Combination C has the following particular advantages:

a) there is no mess to the tiler or the room;

b) there is no need to clean tools;

c) if the tiler makes a mistake or client does not like the job it is very easy to change; and d) there is less physical effort as there is no need for the tiler to keep walking up and down a ladder to re-load a trowel with tile adhesive.

Further advantages include the following:

Installation Temperatures

Unlike traditional cement adhesive systems, installation of the hook-and-loop fastening system is unaffected by installation temperature. As stated in British Standard BS 5385-4:2009 sections 9.1.1 and 9.2.3 tiling using traditional cement based adhesive should be avoided during periods of low and high temperatures. Although the prevailing humidity and degree of air movement might be modifying factors, the approximate temperature range within which installation can be carried out with normal methods and materials is 5° C. to 25° C. In lower temperatures ice crystals will begin to form in the water-based adhesive mix causing delays on building sites if heating systems are not yet connected and can incur additional costs if portable heating systems are required. In higher temperatures the adhesive mix starts to dry too quickly causing difficulties maintaining an accurate powder-to-water ratio when additional top-ups of water are required to keep the adhesive mixture at a suitable consistency, this can be further compounded in warmer regions where water is in short supply. The hook and loop products are applied using robust hot melt adhesives which are commonly used in the automotive industry and are therefore design to operate in a wider range of temperatures with typical values ranging from 40° C. to 70° C. The wider range of installation temperatures of the invention will significantly reduce the time that would normally be lost installing with cement based adhesives.

Weight Savings

When applied as per the manufacturer's instructions the weight of cement based adhesive is approximately 3 kg per square meter. By contrast, the hook-and-loop fastening system of the invention weighs approximately 0.35 kg per square meter, which is 2.65 kg per square meter lighter than conventional adhesive.

The reduction in weight per square meter has a significant impact on overall building weight in high-rise multi-story structures. The reduction in overall building weight facilitates a reduction in cost when calculating the steelwork required for the structural framework.

An alternative benefit can also be achieved if aesthetics are a higher priority than weight savings. Currently, weight restrictions apply to plastered walls and plasterboard, and the maximum allowed weight per square meter is 20 kg for plastered walls and 32 kg for dry plasterboard installations. When adhesive weight is factored into the equation, tile choice can be limited. For example with current weight limits some larger tile sizes that cannot be installed on a plastered wall using traditional adhesive could be installed using the invention therefore widening the customer choice.

Time Savings

If using traditional cement-based adhesive, grouting cannot begin until the adhesive has dried. Adhesives are generally split into two categories: ready mix adhesives and powder-based. Ready mix adhesives have a water-based content, which means that they require between 16 and 24 hours of drying time before grouting can begin. Powder-based adhesives have shorter setting times (approx. 3 hours); however the mixture preparation and clean-up times are longer and they require access to large volumes of water. The invention has time saving advantages over both types of adhesive because grouting can begin as soon as the tiles have been fixed, mixture preparation is removed, clean-up is kept to a minimum and large volumes of water are not required.

Waterproofing

Wet areas in commercial installations such as shower areas in changing rooms need to be watertight, therefore boarding and tiling solutions must be upgraded in these areas to meet the additional waterproofing demands. Normal plasterboard is replaced with moisture resistant board or tile backer-board and further water proofing is added using wet area tanking kits. A tanking kit usually consists of a primer, membrane and tape. Fitting alternative boards and tanking kits can be time consuming and expensive. The hook material element of the invention provides an alternative waterproof membrane and combined with a tanking tape could remove the need for a tanking kit. In domestic bathrooms the levels of waterproofing are often lower than commercial installations with standard plasterboard being replaced with moisture resistant boarding and no other waterproofing element added. The waterproofing properties of the hook material would therefore offer a higher level of protection and potentially removed the need for moisture resistant board.

Replacing Tiles Damaged after Installation

During the construction and refurbishment of buildings tiles are often damaged. With conventional cement-based adhesives, significant effort is required to replace to replace damaged tiles. Due to the permanent properties of traditional cement based adhesive it is very difficult to remove a broken tile without damaging the substrate, cracking surrounding tiles or creating a dusty mess. Using the fastening of the invention, tiles can be removed and replaced easily as follows: step 1—using an oscillating blade tool the grout surrounding the damaged tile can be removed, step 2—using a flat-bladed trowel the damaged tile can be prised away from the hook material and removed without damaging the substrate, step 3—residual grout attached to surrounding tiles can be removed using a sharp blade, step 4—the new loop-backed tile can be positioned and pushed into place to engage the hook/loop elements, and step 5—the area surrounding the new tile can be re-grouted.

Accessing and Repairing Plumbing Leaks after Tile Installation

Water leaks are a reoccurring problem in wet areas such as bathroom and showers. Accessing pipework areas behind traditionally-fixed tiles to repair plumbing faults can be costly, time consuming and messy. Using the removal process described above tiles can be removed quickly without damaging the substrate or creating a mess. The pipework can be accessed by cutting and removing the relevant section of plasterboard. After the leak has been fixed the plasterboard and hook material can be repaired or replaced and pre-hooked tiles can be installed and re-grouted. A further benefit of the invention, when repairing plumbing faults, is the potential to reuse the existing tiles by removing residual grout rather than buying a new set of tiles.

Retail and Hotel Environments

Ceramic tiles are hardwearing, easy to clean and hygienic, making them a popular option for retail and hotel environments. However, due to time restraints, during store or hotel refurbishment tiles are often considered to be a less viable wall covering in these environments. When refurbishment occurs stores or hotel rooms are required to reopen in the shortest time possible. The drying time and clean-up process during conventional tile installation would extend the store or hotel closure period beyond an acceptable duration. By contrast, the fast installation time of the wall covering system of the invention is advantageous. Furthermore, during future refurbishments, the tiles can be easily removed as a result of the low peel strength.

An additional benefit of the easy removability of the wall covering system of the invention is that access for repair of plumbing faults is easier, which can remove the need for plumbing access space between hotel rooms. It is estimated that removing the access space between adjacent hotel rooms could potentially create enough space to fit additional rooms on each floor of a hotel.

Various modifications may be made to the invention described herein. For example, the invention comprehends supplying building products including building panels or boards, such as plasterboard, having pre-applied hook component; 500 mm wide rolls of hook component, 10 meters in length; pre-cut 50 mm PET film rolls having pre-applied hook component for building panel or board such as plasterboard joints and corners; and wall tiles with pre-applied loop component.

For example, the second component of the hook-an-loop fastener may not be supplied as a roll, but may instead be supplied as plasterboard that is already provided with the second component attached to it, or embedded within it. This would remove the time necessary to apply the second component to the wall surface, which would fully streamline the installation process and maximise the time of the wall covering system of the invention. Pre-hooked plaster board will facilitate a rapid tiling process where loop-backed tiles are unpacked, installed and grouted in a single seamless operation.

In the forgoing description, the wall covering system is a tile system for interior wall coverings. However, embodiments are also envisaged in which the wall coverings are designed for external building cladding. In such embodiments, the hook-and-loop engagement forces are strengthened to cater for adverse weather conditions, and glue layers are selected so as to cater for higher and lower temperatures, exposure to chemicals in the atmosphere and higher levels of water penetration.

The Applicant envisages selling building products incorporating the inventive hook and loop fastening systems to the Building Trade, including house builders, architects, interior designers, quantity surveyors, direct commercial customers and POD manufacturers and to Building Retail including tile fitters and consumers.

Depending upon the products and their advantages, the following products and selling points are envisaged for plasterboard with pre-applied hook component and jointing/corner rolls, namely houses, hotels, leisure centres, educational buildings, office buildings, off-site modular building systems and fixers; and for 10 m hook component rolls and jointing/corner rolls, and tile on tile and pre-packed splashbacks, namely consumers.

The invention comprehends the use of a wide variety of surface coverings including: tiles having rigid bodies such as ceramic tiles, porcelain tiles, clay tiles, encaustic tiles, quarry tiles, slate tiles, marble tiles, travertine tile, quartz tiles, natural stone tiles, concrete tiles, cementitious tiles, plaster tiles, glass tiles jesmonite tiles, wooden tiles, vinyl tiles, cork tiles, polyester resin-based tiles, plastic-based tiles, acrylic-based tiles, acrylic polymer-based tile, and laminate tiles; brick slips; wall coverings of wood, vinyl, clay, cork, plaster, glass, jesmonite, concrete, cementitious material, plastic-based material, polyester resin-based material, acrylic-based material, acrylic polymer-based material, and laminate material.

Whilst the invention has been particularly described for use with wall surface coverings of large format tiles, it should be appreciated that the invention also comprehends the use of smaller format tiles having inter alia the dimensions of 100 mm by 100 mm, 150 mm by 150 mm, 200 mm by 100 mm, 200 mm by 200 mm, 300 mm by 100 mm and 300 mm by 200 mm.

The invention claimed is:

1. A wall surface covering system comprising:

a wall surface covering for covering an underlying vertical support surface constituted by a wall, said wall surface covering is a tile having a weight and comprising a rigid body;

a first component of a hook-and-loop fastener fixable to the rigid body of the wall surface covering; and a second component of the hook-and-loop fastener that is fixable to the underlying vertical surface;

wherein the first and second components are cooperable such that, when the first component is fixed to the surface covering and the second component is fixed to the underlying vertical surface, the first and second components are capable of being engaged to cause the wall surface covering to grip the wall; and wherein hooks of a hook component of the hook-and-loop fastener are composed of polypropylene and are mushroom-shaped, and the hook component has a thickness of between approximately 0.3 mm and 0.75 mm; and wherein loops of a loop component of the hook-and-loop fastener are composed of a lightweight knitted material in which a loop weight has a range from 80 to 120 grams per square meter, and the loop component has a thickness of between approximately 0.3 and 0.75 mm;

such that the first and second components are configured to cooperate to provide a fastening having a pull strength in a range of $0.5N/cm^2$ to $2.50N/cm^2$, a shear strength in a range of $20N/cm^2$ to $40N/cm^2$ and a peel strength in a range of $0.2N/cm^2$ to $1.0\ N/cm^2$, to provide the shear strength of the fastening that is greater than a shear force applied by the weight of the tile to hold the surface covering in position on the vertical support surface, and the peel strength that is less than a stress required to fracture the rigid body to allow removal of the surface covering from the underlying surface by peeling the rigid body away from the wall.

2. The wall surface covering of claim 1, wherein the first component is fixed to or integrated with the rigid body.

3. The wall surface covering system as claimed in claim 1, characterised in that one or both of the first and second components have a glued backing for fixing the respective components to a surface.

4. The wall surface covering system as claimed in claim 1, characterised in that the hooks of the hook component comprise a stem and a cap, the cap extending beyond the stem in at least two mutually transverse directions to engage the loop fastening bi-directionally.

5. The wall surface covering system as claimed in claim 1, characterised in that the mushroom-shaped hooks are microscopic, tightly packed and arranged in rows.

6. The wall surface covering system as claimed in claim 1, characterised in that the cooperating engagement properties of the hook and loop components first and second components are configured to provide a synergy that balances, or provides a balance, between relatively high pull strength, relatively high shear strength and relatively low peel strength.

7. The wall surface covering system as claimed in claim 1, characterised in that hook and loop components have a combined thickness which is no greater than approximately 1.5 mm.

8. The wall surface covering system as claimed in claim 1, characterised in that the pull strength is in the range of $1.0N/cm^2$ to $2.0N/cm^2$, the shear strength is in the range of $25N/cm^2$ to $35N/cm^2$ and the peel strength is in the range of $0.4N/cm^2$ to $0.8\ N/cm^2$.

9. The wall surface covering system as claimed in claim 1, characterised in that the pull strength is approximately $1.5N/cm^2$, the shear strength is approximately $30N/cm^2$ and the peel strength is approximately $0.6N/cm^2$.

10. The wall surface covering system as claimed in claim 1, characterised in that the loops of the loop component are carried by a carrier layer of plastics material.

11. The wall surface covering system as claimed in claim 10, characterised in that the carrier layer has a thickness of about 45 microns.

12. A method of installing the wall surface covering system of claim 1, said method comprising:

fixing a first pre-glued component of the hook-and-loop fastener to a wall surface from a supply of such component;

fixing a second pre-glued component of the hook-and-loop fastener from a separate supply of such component to a back of the wall surface covering;

fixing one or more said tiles to the wall surface by pressing the cooperating hook and loop components into engagement with one another such that the tiles are held on the wall surface; and applying grout between, and surrounding, the one or more tiles.

* * * * *